US009806395B2

(12) United States Patent
Li et al.

(10) Patent No.: US 9,806,395 B2
(45) Date of Patent: Oct. 31, 2017

(54) REDUCING COUPLING COEFFICIENT VARIATION USING INTENDED WIDTH MISMATCH

(71) Applicant: Skyworks Solutions, Inc., Woburn, MA (US)

(72) Inventors: Yang Li, Cambridge, MA (US); Xuanang Zhu, Lexington, MA (US); Dinhphuoc Vu Hoang, Anaheim, CA (US); Guohao Zhang, Nanjing (CN); Russ Alan Reisner, Newbury Park, CA (US); Dmitri Prikhodko, Reading, MA (US); Jiunn-Sheng Guo, Eastvale, CA (US); Bradley David Scoles, Lake Forest, CA (US); David Viveiros, Jr., Thousand Oaks, CA (US)

(73) Assignee: Skyworks Solutions, Inc., Woburn, MA (US)

( * ) Notice: Subject to any disclaimer, the term of this patent is extended or adjusted under 35 U.S.C. 154(b) by 257 days.

(21) Appl. No.: 14/576,730

(22) Filed: Dec. 19, 2014

(65) Prior Publication Data

US 2015/0207200 A1 Jul. 23, 2015

Related U.S. Application Data

(63) Continuation of application No. 13/194,876, filed on Jul. 29, 2011, now Pat. No. 8,928,427.

(Continued)

(51) Int. Cl.
*H01P 5/18* (2006.01)

(52) U.S. Cl.
CPC ..... *H01P 5/184* (2013.01); *H01P 5/185* (2013.01); *H01P 5/187* (2013.01);

(Continued)

(58) Field of Classification Search
CPC .. H01P 5/18; H01P 5/184; H01P 5/185; H01P 5/187

(Continued)

(56) References Cited

U.S. PATENT DOCUMENTS 5,235,296 A 8/1993 Saka
5,363,550 A * 11/1994 Aitken ..... H01P 3/06 29/828

(Continued)

FOREIGN PATENT DOCUMENTS

CN 1188995 A 7/1998
CN 1581571 A 2/2005

(Continued)

OTHER PUBLICATIONS

Office Action dated Dec. 24, 2015 in corresponding Taiwanese Patent Application No 100127118, 12 pgs.

(Continued)

*Primary Examiner* — Stephen E Jones
*Assistant Examiner* — Rakesh Patel
(74) *Attorney, Agent, or Firm* — Knobbe, Martens, Olson & Bear, LLP

(57) ABSTRACT

A coupler is presented that has high-directivity and low coupling coefficient variation. The coupler includes a first trace with a first edge substantially parallel to a second edge and substantially equal in length to the second edge. The first trace includes a third edge substantially parallel to a fourth edge. The fourth edge is divided into three segments. The outer segments are a first distance from the third edge. The middle segment is a second distance from the third edge. Further, the coupler includes a second trace, which includes a first edge substantially parallel to a second edge and substantially equal in length to the second edge. The second trace includes a third edge substantially parallel to a fourth (Continued)

edge. The fourth edge is divided into three segments. The outer segments are a first distance from the third edge. The middle segment is a second distance from the third edge.

17 Claims, 14 Drawing Sheets

Related U.S. Application Data

(60) Provisional application No. 61/368,700, filed on Jul. 29, 2010.

(52) U.S. Cl.
CPC .... *Y10T 29/49002* (2015.01); *Y10T 29/49169* (2015.01); *Y10T 29/49208* (2015.01)

(58) Field of Classification Search
USPC ..... 333/109, 111, 116
See application file for complete search history.

(56) References Cited

U.S. PATENT DOCUMENTS

| | | | | |
|---|---|---|---|---|
| 5,621,366 | A * | 4/1997 | Gu | H01P 7/084 333/185 |
| 5,900,618 | A | 5/1999 | Anlage et al. | |
| 6,271,728 | B1 | 8/2001 | Wallace et al. | |
| 6,335,665 | B1 | 1/2002 | Mendelsohn | |
| 6,759,922 | B2 | 7/2004 | Adar et al. | |
| 6,825,738 | B2 * | 11/2004 | Shumovich | H01P 5/185 333/112 |
| 6,903,625 | B2 | 6/2005 | Esker | |
| 7,245,192 | B2 | 7/2007 | Podell | |
| 7,336,142 | B2 | 2/2008 | Vogel | |
| 8,188,808 | B2 | 5/2012 | Ding et al. | |
| 8,330,552 | B2 | 12/2012 | Li et al. | |
| 2002/0057136 | A1 | 5/2002 | Marketkar et al. | |
| 2002/0093384 | A1 | 7/2002 | Woods et al. | |
| 2005/0225411 | A1 | 10/2005 | Sauder et al. | |
| 2006/0109062 | A1 | 5/2006 | Vogel | |
| 2008/0100404 | A1 | 5/2008 | Vice | |
| 2008/0232448 | A1 | 9/2008 | Baker | |
| 2012/0032735 | A1 | 2/2012 | Li et al. | |
| 2012/0038433 | A1 | 2/2012 | Li et al. | |
| 2012/0038436 | A1 | 2/2012 | Li et al. | |
| 2013/0222076 | A1 | 8/2013 | Yi | |

FOREIGN PATENT DOCUMENTS

| | | | |
|---|---|---|---|
| CN | 1747226 | A | 3/2006 |
| CN | 2914356 | Y | 6/2007 |
| CN | 101150219 | A | 3/2008 |
| CN | 101364660 | A | 2/2009 |
| CN | 103125048 | B | 9/2015 |
| CN | 103296367 | B | 2/2016 |
| DE | 19837025 | A1 | 2/2000 |
| JP | H04-131808 | A | 5/1992 |
| JP | H08-078917 | | 3/1996 |
| JP | H11-261313 | A | 9/1999 |
| JP | 2000-165116 | | 6/2000 |
| JP | 3169820 | | 5/2001 |
| JP | 2002-198713 | | 7/2002 |
| JP | 2006-229941 | | 8/2006 |
| JP | 2007-043547 | | 2/2007 |
| JP | 2007-096585 | | 4/2007 |
| JP | 2008-219175 | | 9/2008 |
| KR | 10-2002-21678 | | 3/2002 |
| KR | 20050104124 | A | 11/2005 |
| WO | WO 8706770 | A1 | 11/1987 |
| WO | WO 9015451 | A1 | 12/1990 |
| WO | WO 2012/016087 | A2 | 2/2012 |

OTHER PUBLICATIONS

PCT International Search Report and Written Opinion mailed on Feb. 27, 2012 for International Application No. PCT/US2011/045799, 14 pages.

Office Action dated Nov. 1, 2016 in corresponding Korean Patent Application No. 9-5-2016-078991782, 5 pgs.

Office Action dated Nov. 1, 2016 in corresponding Korean Patent Application No. 9-5-2016-078991636, 5 pgs.

Hoffman, R. "Handbook of Microwave Integrated Circuits", The Artech House Microwave Library, 5 pgs.

* cited by examiner 200
202
GAP W
204
W
L 200
202
GAP W
204
W
W 210
212
GAP W
214
216
217
218
A
W2
W1
L1
L2
L3

220
222
GAP W
224
226
227
228
A
W2
W1
L1
L2
L3

ABSCISSA
(X-DIRECTION)
ORDINATE
(Y-DIRECTION)

REDUCING COUPLING COEFFICIENT VARIATION USING INTENDED WIDTH MISMATCH

RELATED APPLICATIONS

This application is a continuation of U.S. application Ser. No. 13/194,876 (now U.S. Pat. No. 8,928,427), filed on Jul. 29, 2011 and titled "REDUCING COUPLING COEFFICIENT VARIATION USING INTENDED WIDTH MISMATCH," which claims the benefit of priority under 35 U.S.C. §119(e) of U.S. Provisional Patent Application No. 61/368,700, filed on Jul. 29, 2010, and entitled "SYSTEM AND METHOD FOR REDUCING COUPLING COEFFICIENT VARIATION UNDER VSWR USING INTENDED MISMATCH IN DAISY CHAIN COUPLERS." The disclosures of both applications are hereby incorporated by reference in their entirety.

BACKGROUND

Field

The present disclosure generally relates to the field of couplers, and more particularly, to systems and methods for reducing coupling coefficient variation.

Description of the Related Art

In certain applications, such as third generation (3G) mobile communication systems, robust and accurate power control under load variation is desired. To achieve this, high directivity couplers are often used with power amplifier modules (PAMs). The couplers directivity is typically limited to 12-18 dB in order to maintain a coupler factor variation, or peak-to-peak error, of between ±1 dB and ±0.4 dB with an output Voltage Standing Wave Ratio (VSWR) of 2.5:1.

However, new multi-band and multi-mode devices, and new handset architectures that use Daisy Chain Couplers to share power between different bands require much higher directivity with a lower coupler factor variation. Achieving such requirements is becoming more difficult as demand for smaller chip packages increases.

SUMMARY

In accordance with some embodiments, the present disclosure relates to a coupler with high-directivity and low coupler factor variation that can be used with, for example, a 3 mm×3 mm Power Amplifier Module (PAM). The coupler includes a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the coupler includes a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

In accordance with some embodiments, the present disclosure relates to a packaged chip that includes a coupler with high-directivity and low coupler factor variation that can be used with, for example, a 3 mm×3 mm PAM.

According to other embodiments of this invention, the present disclosure relates to a wireless device that includes a coupler with high-directivity and low coupler factor variation that can be used with, for example, a 3 mm×3 mm PAM.

Still in accordance with further embodiments hereof, the present disclosure relates to a strip coupler with high-directivity and low coupler factor variation that can be used with, for example, a 3 mm×3 mm PAM. The strip coupler includes a first strip and a second strip positioned relative to each other. Each strip has an inner coupling edge and an outer edge. The outer edge has one segment where a width of the strip differs from one or more additional widths associated with one or more additional segments of the strip. Further, the strip coupler includes a first port configured substantially as an input port and associated with the first strip. The strip coupler also includes a second port configured substantially as an output port and associated with the first strip. In addition, the strip coupler includes a third port configured substantially as a coupled port and associated with the second strip. The strip coupler further includes a fourth port configured substantially as an isolated port and associated with the second strip.

And in accordance with yet further embodiments hereof, the present disclosure relates to a method of manufacturing a coupler with high-directivity and low coupler factor variation that can be used with, for example, a 3 mm×3 mm PAM. The method includes forming a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the method includes forming a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

According to still yet further embodiments of the present invention, this disclosure further relates to a coupler with high-directivity and low coupler factor variation that can be used with, for example, a 3 mm×3 mm PAM. The coupler includes a first trace associated with a first port and a second port. The first trace includes a first main arm, a first connecting trace connecting the first main arm to the second port, and a non-zero angle between the first main arm and the first connecting trace. Further, the coupler includes a second trace associated with a third port and a fourth port. The second trace includes a second main arm.

And still in further embodiments hereof, the present disclosure relates to a strip coupler with high-directivity and low coupler factor variation that can be used with, for example, a 3 mm×3 mm PAM. The strip coupler including a first strip and a second strip positioned relative to each other. Each strip has an inner coupling edge and an outer edge. The first strip includes a connecting trace connecting a main arm of the first strip to a second port. The connecting trace and the main arm are joined at a non-zero angle. The second strip includes a main arm communicating with a fourth port without the main arm joined to a connecting trace at a non-zero angle. The strip coupler further includes a first port configured substantially as an input port and associated with the first strip. The second port is configured substantially as an output port and associated with the first strip. In addition, the strip coupler includes a third port configured substantially as a coupled port and associated with the second strip. The fourth port is configured substantially as an isolated port and associated with the second strip.

Still other embodiments hereof relate to a method of manufacturing a coupler with high-directivity and low coupler factor variation that can be used with, for example, a 3 mm×3 mm PAM. The method includes forming a first trace associated with a first port and a second port. The first trace includes a first main arm, a first connecting trace connecting the first main arm to the second port, and a non-zero angle between the first main arm and the first connecting trace. The method further includes forming a second trace associated with a third port and a fourth port. The second trace includes a second main arm.

And in alternate preferred embodiments, the present disclosure relates to a coupler with high-directivity and low coupler factor variation that can be used with, for example, a 3 mm×3 mm PAM. The coupler includes a first trace associated with a first port and a second port. The first port is configured substantially as an input port and the second port is configured substantially as an output port. The coupler further includes a second trace associated with a third port and a fourth port. The third port is configured substantially as a coupled port and the fourth port is configured substantially as an isolated port. In addition, the coupler includes a first capacitor configured to introduce a discontinuity to induce a mismatch in the coupler.

In accordance with still additional further embodiments, the present disclosure relates to a method of manufacturing a coupler with high-directivity and low coupler factor variation that can be used with, for example, a 3 mm×3 mm PAM. The method includes forming a first trace associated with a first port and a second port. The first port is configured substantially as an input port and the second port is configured substantially as an output port. The method further includes forming a second trace associated with a third port and a fourth port. The third port is configured substantially as a coupled port and the fourth port is configured substantially as an isolated port. In addition, the method includes connecting a first capacitor to the second port. The first capacitor is configured to introduce a discontinuity to induce a mismatch in the coupler.

The present disclosure relates to U.S. application Ser. No. 13/194,863 (now U.S. Pat. No. 8,941,449), titled "REDUCING COUPLING COEFFICIENT VARIATION BY USING ANGLED CONNECTING TRACES," and U.S. application Ser. No. 13/194,864 (now U.S. Pat. No. 8,928,426), titled "REDUCING COUPLING COEFFICIENT VARIATION BY USING CAPACITORS," each filed on Jul. 29, 2011 and each incorporated by reference herein in its entirety.

BRIEF DESCRIPTION OF THE DRAWINGS

Throughout the drawings, reference numbers are re-used to indicate correspondence between referenced elements. The drawings are provided to illustrate embodiments of the inventive subject matter described herein and not to limit the scope thereof.

DETAILED DESCRIPTION

Introduction

Traditionally, designers attempt to match and isolate couplers to achieve improved directivity with minimal coupling factor variation, or minimal peak-to-peak error. Theoretical analysis by researchers shows that a strip coupler can be ideally matched and perfectly isolated, if its inductive coupling coefficient equals its capacitive coupling coefficient.

$$\frac{C_m}{\sqrt{C_1 C_2}} = \frac{L_m}{\sqrt{L_1 L_2}} \tag{1}$$

However, meeting this condition generally requires layout symmetry along coupler arm direction and proper permittivity of substrate material. In many applications, it is not feasible to use traditional coupler designs to meet required coupler specifications. For example, in current power amplifier module (PAM) designs, the dielectric constant is mostly determined by laminate technology and the symmetry requirements of coupler arms can not be easily met when the demands of compact packaging design reduces the space available for the coupler. Thus, as PAM size is reduced to 3 mm×3 mm and smaller, it is becoming more difficult to achieve the specifications required to integrate a coupler with the PAM.

Embodiments of the present disclosure provide apparatus and methods for minimizing coupler factor variation, or peak-to-peak error, below an output VSWR of 2.5:1. Coupler factor variation is reduced by introducing a mismatch at an output port of a trace, or a main arm. The introduction of the mismatch increases directivity based on a cancellation effect. This principle is explained mathematically below using FIG. 1.

Figure 1:
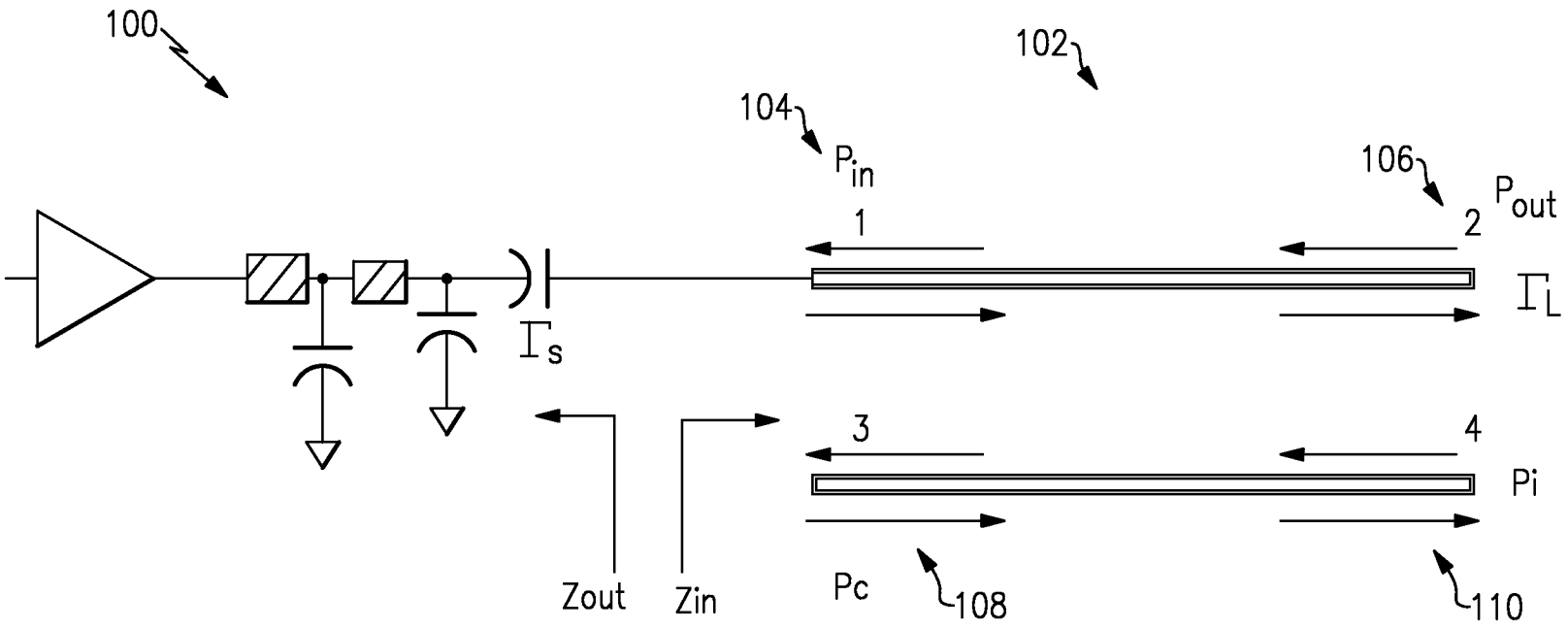
FIG. 1 illustrates an embodiment of a coupler in communication with a circuit providing an input signal to the coupler in accordance with the present disclosure.

FIG. 1 illustrates an embodiment of a coupler 102 in communication with a circuit 100 providing an input signal to the coupler 102 in accordance with the present disclosure. The circuit 100 can generally include any circuit that can provide an input signal to the coupler 102. For example, although not limited as such, the circuit 100 can be a PAM.

The coupler 102 includes four ports: port 104, port 106, port 108, and port 110. In the illustrated embodiment, port 104 represents an input port Pin where power is generally applied. Port 106 represents an output port Pout or transmitted port where power from the input port minus the coupled power is outputted. Port 108 represents the coupled port Pc where a portion of the power applied to the input port is directed. Port 110 represents the isolated port Pi, which is generally, although not necessarily, terminated with a matched load.

Often, coupler performance is measured based on the coupling factor and the coupling factor variation, or peak-to-peak error. The coupling factor, Cpout, is the ratio of the power at the output port, port 106, to the power at the coupled port, port 108, and may be calculated using equation 2.

$$C_{pout} = \frac{P_{out}}{P_c} \tag{2}$$

Coupling factor variation is determined based on the maximum change of the coupling factor and may be calculated using equation 3.

$$P_k = \max(\Delta C_{pout})|_{VSWR} \tag{3}$$

Defining $\Gamma_L$ as the load impedance normalized to 50 Ohms and $S_{ij}$ as the coupler's scattering, or S parameter, under matched conditions for power that is received at port i when input at port j, and assuming there is no reflectance at the coupled port and the isolated port (i.e. $S_{33}=S_{44}=0$), equation 4 can be derived for the coupling factor, Cpout.

$$C_{pout} = \frac{|S_{21}|\sqrt{(1-|\Gamma_L|^2)}}{|S_{31}|\left(\left|1+\left(\frac{S_{21}S_{32}}{S_{31}}-S_{22}\right)\Gamma_L\right|\right)} \tag{4}$$

The coupling factor variation measured in decibels can then be derived using equation 5.

$$\text{Pk_dB} = 20\log_{10}\left|\frac{1+\left|\left(\frac{S_{21}S_{32}}{S_{31}}-S_{22}\right)\Gamma_L\right|}{1-\left|\left(\frac{S_{21}S_{32}}{S_{31}}-S_{22}\right)\Gamma_L\right|}\right| \tag{5}$$

The S parameter is associated with the transmission coefficient T and the coupling coefficient K of the coupler each of which are complex values comprising a phase and an amplitude. In certain embodiments, by changing at least one of the geometry of a coupler trace, the angle of a connecting trace to a main trace of the coupler, and the characteristics of a capacitor connected to a coupler trace, the values of the S parameter can be modified. By adjusting the S parameter, in some implementations, the coupler directivity can by increased while the coupling factor variation can be reduced.

When the output port, port 106, is not perfectly matched, the equivalent directivity can be defined using equation 6.

$$D = \left|\frac{1}{\frac{S_{32}}{S_{31}}-\frac{S_{22}}{S_{21}}}\right| \tag{6}$$

When the output port is perfectly matched, equation 6 is reduced to the equation for calculating coupler directivity, as illustrated by equation 7.

$$D = \left|\frac{S_{31}}{S_{32}}\right| \tag{7}$$

Similarly, the equation for determining the coupler factor variation, equation 5, can be reduced to equation 8.

$$\text{Pk_dB} = 20\log_{10}\left|\frac{1+\left|\frac{S_{21}}{D}\Gamma_L\right|}{1-\left|\frac{S_{21}}{D}\Gamma_L\right|}\right| \tag{8}$$

Examining equation 8, it can be seen that the higher the directivity D, the lower the coupling factor variation. Further, when a coupler's directivity is limited by the coupler's size constraints and/or cross-coupling between the coupler and other circuit traces, equation 6 shows that adjusting the amplitude and phase of the S parameter $S_{ij}$ to cancel part of $S_{32}/S_{31}$ will improve equivalent directivity. This can be accomplished by creating a discontinuity in the coupler to purposely induce mismatch. Throughout this disclosure, several non-limiting examples of coupler designs are presented that have improved directivity and coupler factor variation compared to pre-existing coupler designs. In certain embodiments, the couplers presented herein can be used with 3 mm×3 mm and smaller module packages, as well as with larger packages.

Examples of Edge Strip Couplers

Figures 2A, 2B, 2C, 2D:
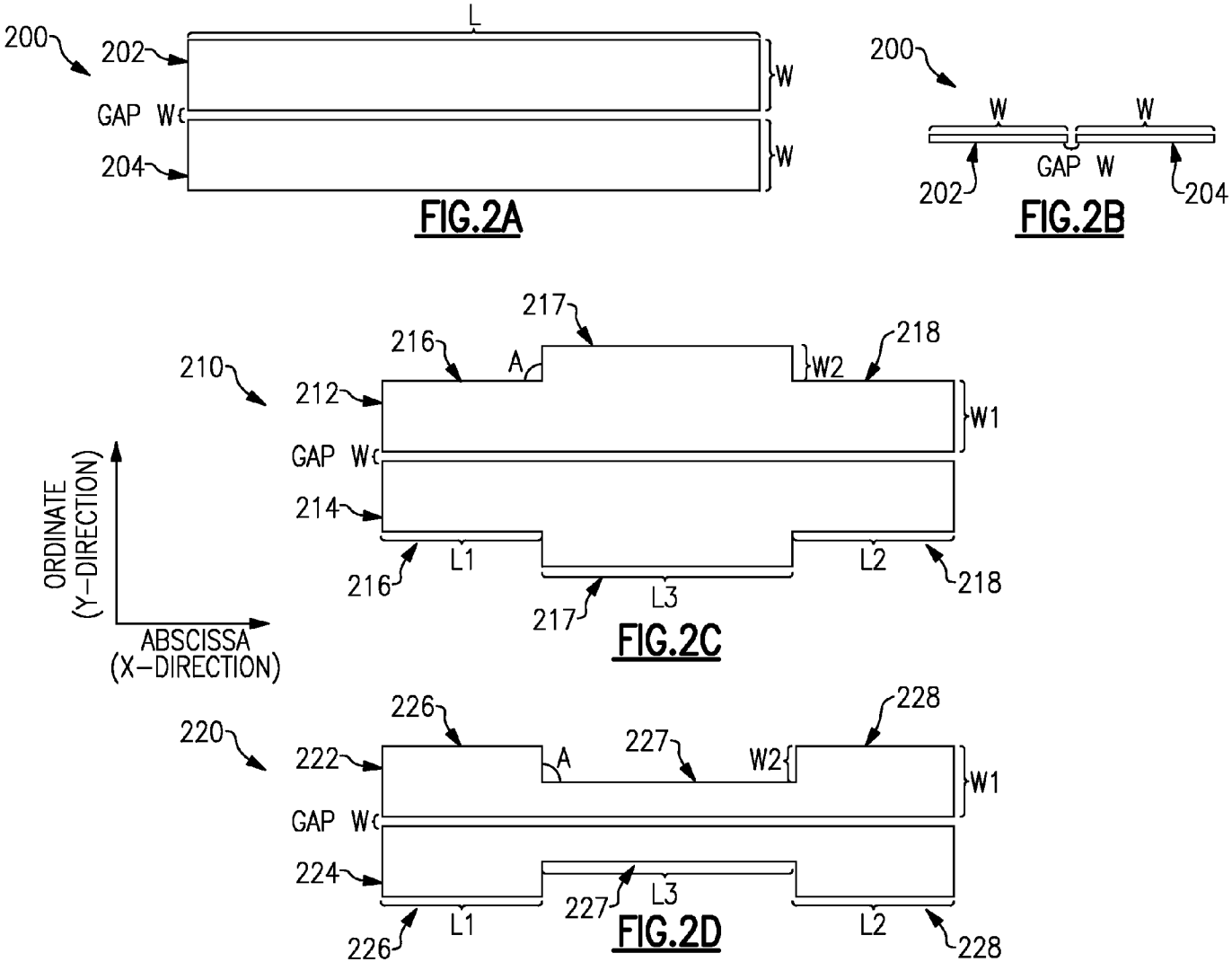
FIGS. 2A-2B illustrate embodiments of an edge strip coupler.
FIGS. 2C-2D illustrate embodiments of edge strip couplers in accordance with the present disclosure.

FIG. 2A illustrates an embodiment of an edge strip coupler 200. The edge strip coupler 200 includes two traces 202 and 204. The trace 202 and the trace 204 are each of equal length L and equal width W. Further, a gap width, GAP W, exists between the trace 202 and the trace 204. The gap width is selected to allow a pre-determined portion of power provided to one trace to be coupled to the second trace. As depicted in FIG. 2B, the trace 202 and the trace 204 are located in the same horizontal plane such that one trace is next to the other trace.

Each trace may be associated with two ports (not shown) as previously described with respect to FIG. 1. For example, the trace 202 may be associated with an input port on the left end (the side with the label GAP W) and an output port on the right end (the side with the labels W) of the trace. Likewise, the trace 204 may be associated with a coupled port on the left end and an isolated port on the right end of the trace. Of course, in some embodiments, the ports may be swapped such that the input port and the coupled port are on the right while the output port and the isolated port are on the left of the traces. In some embodiments, the coupled port may be on the right end and the isolated port may be on the left end of the trace 204, while the input port remains on the left end of the trace 202 and the output port remains on the right end of the trace 202. Further, in certain embodiments, the input port and the output port may be associated with the trace 204 and the coupled port and the isolated port may be associated with the trace 202. In certain embodiments, the traces 202 and 204 are connected with the ports by connecting traces (not shown). In some embodiments, the traces communicate with the ports by the use of vias that connect the main arms of the traces with the ports.

FIGS. 2C-2D illustrate embodiments of edge strip couplers in accordance with the present disclosure. Each of the edge strip couplers may be associated with four ports as previously described above. Further, each trace of the couplers may communicate with the ports using connecting arms or vias as described above. FIG. 2C illustrates an embodiment of an edge strip coupler 210 that includes a first trace 212 and a second trace 214. As illustrated in FIG. 2C, each trace may be divided into three segments 216, 217, and 218. In certain embodiments, by dividing the trace 212 and the trace 214 into three segments, a discontinuity is created. Generally, the trace 212 and the trace 214 are positioned in the same horizontal plane, similar to coupler 200 illustrated in FIG. 2B, such that an inner unbroken coupling edge of the trace 212 is aligned parallel with an inner unbroken coupling edge of the trace 214 with a gap width, GAP W, as illustrated in FIG. 2C. However, in some embodiments, the position of the trace 214 may be adjusted relative to the position of the trace 212. Further, generally the trace 212 and the trace 214 are mirror images sharing equal dimensions. However, in some embodiments, the trace 212 and the trace 214 may differ. For example, the length and/or the width of the segment 217 associated with the trace 212 may differ from the length and/or width of the segment 217 associated with the trace 214.

Advantageously, in some embodiments, by adjusting one or more of the lengths L1, L2, and L3 of each trace and/or one or more of the widths W1 and W2 of each trace, the equivalent directivity can be increased for a given coupling factor while improving the coupling factor variation as calculated using equations 6, 4 and 5 respectively for a target operating frequency.

In certain embodiments, L1 and L2 are equal. Further, L3 may or may not be equal to L1 and L2. In other embodiments, L1, L2 and L3 may all differ. Generally, L1, L2, and L3 are the same for the trace 212 and the trace 214. However, in some embodiments, one or more of the lengths of the segments of the trace 212 and the trace 214 may differ. Similarly, the widths W1 and W2 for the trace 212 and for the trace 214 are generally equal. However, in some embodiments, one or more of the widths W1 and W2 may differ for the trace 212 and the trace 214. Generally, both W1 and W2 are non-zero.

In certain embodiments, the angle A created between the segment 216 and the segment 217 is 90 degrees. Further, the angle between the segment 217 and the segment 218 is also 90 degrees. However, in certain embodiments, one or more of the angles between the three segments may differ. Thus, in some embodiments, the segment 217 may extend in the ordinate direction from the trace 212 and the trace 214 in a more gradual manner than illustrated.

FIG. 2D illustrates an embodiment of an edge strip coupler 220 that includes a first trace 222 and a second trace 224. As can be seen by comparing FIG. 2D with FIG. 2C, the coupler 220 is an inverted version of the coupler 210. As illustrated in FIG. 2D, each trace may be divided into three segments 226, 227, and 228. In certain embodiments, by dividing the trace 222 and the trace 224 into three segments, a discontinuity is created. Generally, the trace 222 and the trace 224 are positioned in the same horizontal plane, similar to coupler 200 illustrated in FIG. 2B, such that an inner unbroken coupling edge of the trace 222 is aligned parallel with an inner unbroken coupling edge of the trace 224 with a gap width, GAP W, as illustrated in FIG. 2D. However, in some embodiments, the position of the trace 224 may be adjusted relative to the position of the trace 222. Further, generally the trace 222 and the trace 224 are mirror images sharing equal dimensions. However, in some embodiments, the trace 222 and the trace 224 may differ. For example, the length and/or the width of the segments 226 and 228 associated with the trace 222 may differ from the length and/or width of the segments 226 and 228 associated with the trace 224.

Advantageously, in some embodiments, by adjusting one or more of the lengths L1, L2, and L3 of each trace and/or one or more of the widths W1 and W2 of each trace, the equivalent directivity can be increased for a given coupling factor while improving the coupling factor variation as calculated using equations 6, 4 and 5 respectively for a target operating frequency.

In certain embodiments, L1 and L2 are equal. Further, L3 may or may not be equal to L1 and L2. In other embodiments, L1, L2 and L3 may all differ. Generally, L1, L2, and L3 are the same for the trace 222 and the trace 224. However, in some embodiments, one or more of the lengths of the segments of the trace 222 and the trace 224 may differ. Similarly, the widths W1 and W2 for the trace 222 and for the trace 224 are generally equal. However, in some embodiments, one or more of the widths W1 and W2 may differ for the trace 222 and the trace 224. Generally, both W1 and W2 are non-zero.

In certain embodiments, the angle A created between the segment 226 and the segment 227 is 90 degrees. Further, the angle between the segment 227 and the segment 228 is also 90 degrees. However, in certain embodiments, one or more of the angles between the three segments may differ. Thus, in some embodiments, the segments 226 and 228 may extend in the ordinate direction from the trace 222 and the trace 224 in a more gradual manner than illustrated.

Examples of Layered Strip and Layered Wide-Side Strip Couplers

Figure 3B:
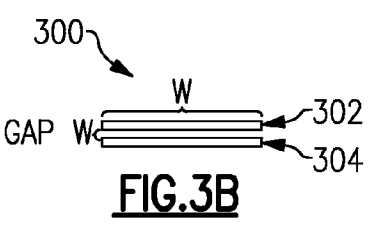
FIGS. 3A-3B illustrate embodiments of a layered coupler.
Figure 3A:
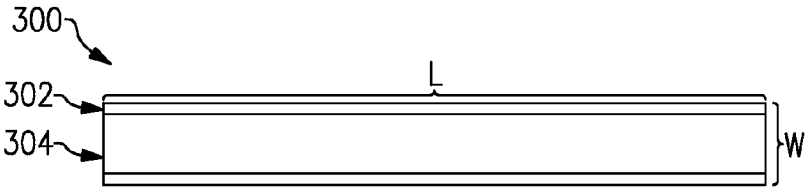

FIGS. 3A-3B illustrate embodiments of a layered strip coupler 300. The layered strip coupler 300 includes two traces 302 and 304. Although the traces 302 and 304 are depicted as having different widths, this is primarily for ease of illustration. FIG. 3B more clearly illustrates that the two traces are of equal width. Further, the trace 302 and the trace 304 are of equal length L. In addition, as illustrated in FIG. 3B, a gap width, GAP W, exists between the trace 302 and the trace 304. The gap width is selected to enable a preselected portion of power provided to one trace to be coupled to the second trace.

Each trace may be associated with two ports (not shown) as previously described with respect to FIG. 1. For example, referring to FIG. 3A, the trace 302 may be associated with an input port on the left end (the side with the labels 302 and 304) and an output port on the right end (the side with the label W) of the trace. Likewise, the trace 304 may be associated with a coupled port on the left end and an isolated port on the right end of the trace. Of course, in some embodiments, the ports may be swapped such that the input port and the coupled port are on the right while the output port and the isolated port are on the left of the traces. In some embodiments, the coupled port may be on the right end and the isolated port may be on the left end of the trace 304, while the input port remains on the left end of the trace 302 and the output port remains on the right end of the trace 302. Further, in certain embodiments, the input port and the output port may be associated with the trace 304 and the coupled port and the isolated port may be associated with the trace 302. In certain embodiments, the traces 302 and 304 are connected with the ports by connecting traces (not shown). In some embodiments, the traces communicate with the ports by the use of vias that connect the main arms of the traces with the ports.

Figure 3C:
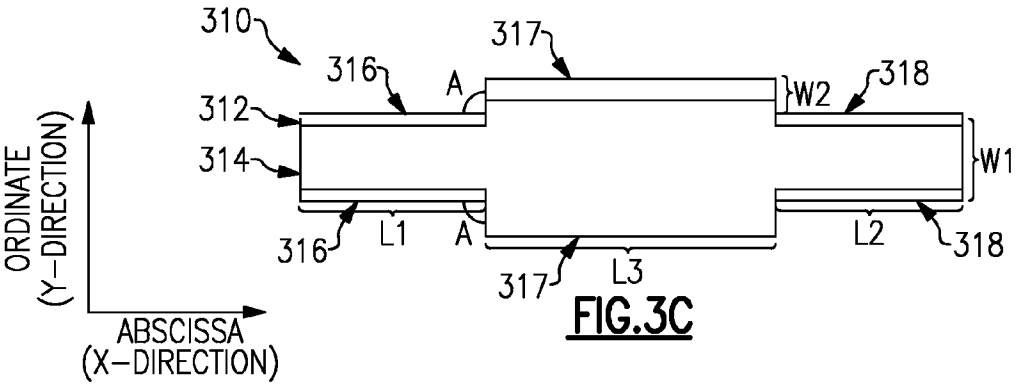
FIGS. 3C-3D illustrate embodiments of wide-side strip layered couplers in accordance with the present disclosure.
Figure 3D:
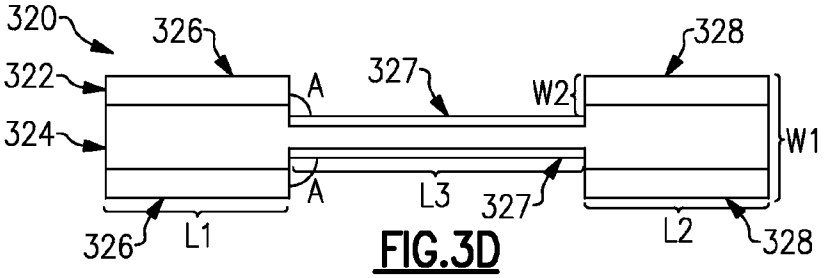

FIGS. 3C-3D illustrate embodiments of layered wide-side strip couplers in accordance with the present disclosure. Each of the layered wide-side strip couplers may be associated with four ports as previously described above. Further, each trace of the couplers may communicate with the ports using connecting arms or vias as described above. FIG. 3C illustrates an embodiment of a layered wide-side strip coupler 310 that includes a first trace 312 and a second trace 314. As illustrated in FIG. 3C, each trace may be divided along its length into three pairs of mirrored segments 316, 317, and 318. In certain embodiments, if each trace were bisected along its length, the two halves would be substantially identical mirror images. However, in some embodiments, the two halves may be sized differently. For example, the segment 317 may extend further in the positive ordinate direction than the corresponding segment 317 extends in the negative ordinate direction. In certain embodiments, by dividing the trace 312 and the trace 314 into three segments, a discontinuity is created.

Generally, the trace 312 and the trace 314 are positioned in the same vertical plane such that one trace is located directly above the second trace with a space between the two traces, similar to that depicted with respect to coupler 300 in FIG. 3B. However, in some embodiments, the position of the trace 314 may be adjusted relative to the position of the trace 312. Further, generally the trace 312 and the trace 314 are substantially equal in shape and size. However, in some embodiments, the trace 312 and the trace 314 may differ in size and shape. For example, the length and/or the width of the segment 317 associated with the trace 312 may differ from the length and/or width of the segment 317 associated with the trace 314.

Advantageously, in some embodiments, by adjusting one or more of the lengths L1, L2, and L3 of each trace and/or one or more of the widths W1 and W2 of each trace, the equivalent directivity can be increased for a given coupling factor while improving the coupling factor variation as calculated using equations 6, 4 and 5 respectively for a target operating frequency. In certain embodiments, the lengths L1, L2, and L3, and the width W1 of each trace are adjusted equally for each outer edge of the trace. However, in some embodiments, the dimensions of each outer edge of each trace may be adjusted independently.

In certain embodiments, L1 and L2 are equal. Further, L3 may or may not be equal to L1 and L2. In other embodiments, L1, L2 and L3 may all differ. Generally, L1, L2, and L3 are the same for the trace 312 and the trace 314. However, in some embodiments, one or more of the lengths of the segments of the trace 312 and the trace 314 may differ. Similarly, the widths W1 and W2 for the trace 312 and for the trace 314 are generally equal. However, in some embodiments, one or more of the widths W1 and W2 may differ for the trace 312 and the trace 314. Generally, both W1 and W2 are non-zero. Further, as described above, each outer edge of each trace may share equal dimensions or may differ. In certain embodiments, each corresponding outer edge of each trace may differ or may be equal.

In certain embodiments, the angle A created between the segment 316 and the segment 317 is 90 degrees. Further, the angle between the segment 317 and the segment 318 is also 90 degrees. However, in certain embodiments, one or more of the angles between the three segments may differ. Thus, in some embodiments, the segment 317 may extend in the ordinate direction from the trace 312 and the trace 314 in a more gradual manner than illustrated. Further, although the angle A is generally equal for each of the outer edges of the traces, in some embodiments, the angles may differ.

FIG. 3D illustrates an embodiment of a layered wide-side strip coupler 320 that includes a first trace 322 and a second trace 324. As can be seen by comparing FIG. 3D with FIG. 3C, the coupler 320 is an inverted version of the coupler 310. As illustrated in FIG. 3D, each trace may be divided along its length into three pairs of mirrored segments 326, 327, and 328. In certain embodiments, if each trace were bisected along its length, the two halves would be substantially identical mirror images. However, in some embodiments, the two halves may be sized differently. For example, the segments 326 and 328 may extend further in the positive ordinate direction than the corresponding segments 326 and 328 extend in the negative ordinate direction. In certain embodiments, by dividing the trace 322 and the trace 324 into three segments, a discontinuity is created.

Generally, the trace 322 and the trace 324 are positioned in the same vertical plane such that one trace is located directly above the second trace with a space between the two traces, similar to that depicted with respect to coupler 300 in FIG. 3B. However, in some embodiments, the position of the trace 324 may be adjusted relative to the position of the trace 322. Further, generally the trace 322 and the trace 324 are substantially equal in shape and size. However, in some embodiments, the trace 322 and the trace 324 may differ in size and shape. For example, the length and/or the width of the segments 326 and 328 associated with the trace 322 may differ from the length and/or width of the segments 326 and 328 associated with the trace 324.

Advantageously, in some embodiments, by adjusting one or more of the lengths L1, L2, and L3 of each trace and/or one or more of the widths W1 and W2 of each trace, the equivalent directivity can be increased for a given coupling factor while improving the coupling factor variation as calculated using equations 6, 4 and 5 respectively for a target operating frequency. In certain embodiments, the lengths L1, L2, and L3, and the width W1 of each trace are adjusted equally for each outer edge of the trace. However, in some embodiments, the dimensions of each outer edge of each trace may be adjusted independently.

In certain embodiments, L1 and L2 are equal. Further, L3 may or may not be equal to L1 and L2. In other embodiments, L1, L2 and L3 may all differ. Generally, L1, L2, and L3 are the same for the trace 322 and the trace 324. However, in some embodiments, one or more of the lengths of the segments of the trace 322 and the trace 324 may differ. Similarly, the widths W1 and W2 for the trace 322 and for the trace 324 are generally equal. However, in some embodiments, one or more of the widths W1 and W2 may differ for the trace 322 and the trace 324. Generally, both W1 and W2 are non-zero. Further, as described above, each outer edge of each trace may share equal dimensions or may differ. In certain embodiments, each corresponding outer edge of each trace may differ or may be equal.

In certain embodiments, the angle A created between the segment 326 and the segment 327 is 90 degrees. Further, the angle between the segment 327 and the segment 328 is also 90 degrees. However, in certain embodiments, one or more of the angles between the three segments may differ. Thus, in some embodiments, the segments 326 and 328 may extend in the ordinate direction from the trace 312 and the trace 314 in a more gradual manner than illustrated. Further, although the angle A is generally equal for each of the outer edges of the traces, in some embodiments, the angles may differ. Moreover, in some embodiments, the angle between the segment 326 and the segment 327 may differ from the angle between the segment 327 and the segment 328.

Although the traces 314 and 324 are depicted as being located above the traces 312 and 322 respectively, in some embodiments, the traces 314 and 324 may be positioned below the traces 312 and 322 respectively. Further, although the traces are depicted as being aligned within the same vertical plane, in some embodiments, the traces may be aligned off-center.

Examples of Angled Couplers

Figure 4A:
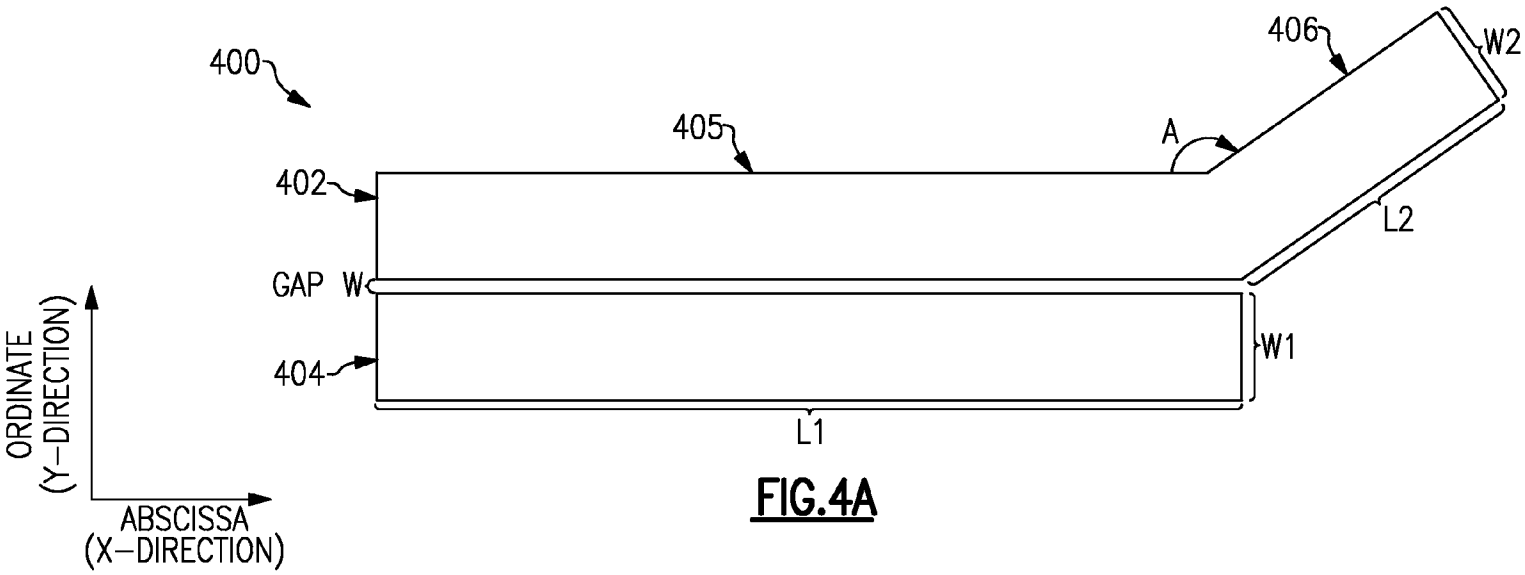
FIGS. 4A-4B illustrate embodiments of angled couplers in accordance with the present disclosure.
Figure 4B:
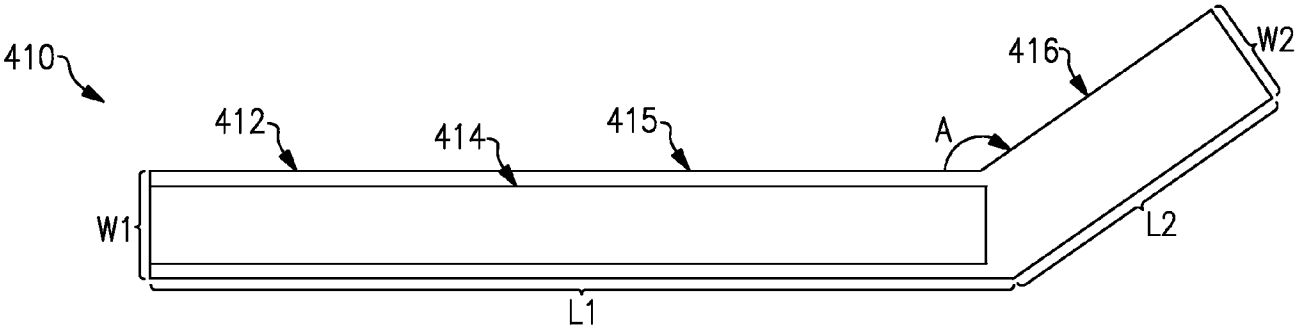

FIGS. 4A-4B illustrate embodiments of angled couplers in accordance with the present disclosure. FIG. 4A illustrates an embodiment of an angled strip coupler 400 that includes a first trace 402 and a second trace 404. The first trace 402 includes two segments, a main arm 405 and a connecting trace 406 that is joined to the main arm 405 at an angle A. The second trace 404 includes a main arm without a connecting trace. Alternatively, the second trace 404 includes the connecting trace 406, and the first trace 402 includes a main arm without a connecting trace. In some embodiments, both the trace 402 and the trace 404 include connecting traces connected to main traces at an angle A.

The connecting trace 406 leads to a port (not shown) associated with the coupler 400. Although not limited as such, the port is generally the output port of the coupler 400. The main arm 405 of trace 402 and the trace 404 are each of equal length L1 and equal width W1. Further, a gap width, GAP W, exists between the main arm 405 and the trace 404. The gap width is selected to allow a pre-determined portion of power provided to one trace to be coupled to the second trace.

The connecting trace 406 is of length L2 and width W2. In some embodiments, the width W2 is equal to the width W1. In other embodiments, the width of the connecting trace 406 may be narrower than the width of the traces 402 and 404. In some embodiments, the narrowing of the connecting trace 406 may be gradual reaching its final width W2 at the point where the connecting trace 406 connects to, for example, the output port. Alternatively, the narrowing of the connecting trace may occur more rapidly resulting in the connecting trace 406 reaching its final width W2 at some point prior to the point where the connecting trace 406 connects with, for example, the output port.

In certain embodiments, the coupler 400 is associated with four ports. Each trace may be associated with two ports (not shown) as previously described with respect to FIG. 1. For example, referring to FIG. 4A, the trace 402 may be associated with an input port on the left end (the side without the angled connecting trace 406) and an output port on the right end (the side with the angled connecting trace 406) of the trace 402. Likewise, the trace 404 may be associated with a coupled port on the left end and an isolated port on the right end of the trace 404. Of course, in some embodiments, the ports may be swapped such that the input port and the coupled port are on the right while the output port and the isolated port are on the left of the traces. In some embodiments, the coupled port may be on the right end and the isolated port may be on the left end of the trace 404, while the input port remains on the left end of the trace 402 and the output port remains on the right end of the trace 402. Further, in certain embodiments, the input port and the output port may be associated with the trace 404 and the coupled port and the isolated port may be associated with the trace 402.

As illustrated in FIG. 4A, at least one of the ports is connected to the coupler using the connecting trace 406. In certain embodiments, the remaining ports may communicate with the traces 402 and 404 using additional connecting traces (not shown). In such embodiments, the additional connecting traces connect at a different angle to the traces than the connecting trace 406 thereby inducing a mismatch in the coupler through the discontinuity of the connecting traces. In some embodiments, the additional connecting traces connect at a zero-degree angle with the main arms of the traces. In some embodiments, one or more connecting traces may connect with the main traces at an angle A. However, generally at least one of the connecting traces connects with one of the main traces at a non-zero angle or at an angle besides A thereby creating mismatch in the coupler.

In some embodiments, the ports may communicate with the traces 402 and 404 by the use of vias that connect the main arms of the traces with the ports.

Generally, the trace 402 and the trace 404 are positioned in the same horizontal plane such that an inner coupling edge of the main arm 405 of the trace 402 is aligned parallel with an inner coupling edge of the trace 404 with a gap width, GAP W, as illustrated in FIG. 4A. However, in some embodiments, the position of the trace 404 may be adjusted relative to the position of the main arm 405 of the trace 402. Further, generally the main arm of the trace 402 and the trace 404 are equal in size. However, in some embodiments, the main arm of the trace 402 and the trace 404 may differ in size. For example, the length and/or the width of the main arm 405 of the trace 402 may differ from the length and/or width of the trace 404.

Advantageously, in some embodiments, by adjusting one or more of the lengths L2, width W2, and the angle A of the connecting trace 406, the equivalent directivity can be increased for a given coupling factor while improving the coupling factor variation as calculated using equations 6, 4 and 5 respectively for a target operating frequency.

In certain embodiments, the angle A created between the segment main arm 405 and the connecting trace 406 is between 90 degrees and 150 degrees. In other embodiments, the angle A can include any non-zero angle.

FIG. 4B illustrates an embodiment of a layered angled strip coupler 410 that includes a first trace 412 and a second trace 414. The first trace 412 includes two segments, a main arm 415 and a connecting trace 416 that is joined to the main arm 415 at an angle A. The second trace 414 includes a main arm without a connecting trace. Alternatively, the second trace 414 includes the connecting trace 416, and the first trace 412 includes a main arm without a connecting trace. In some embodiments, both the trace 412 and the trace 414 include connecting traces connected to main traces at an angle A.

The layered angled strip coupler 410 is substantially similar to the angled strip coupler 400 and each of the embodiments described with respect to the coupler 400 may apply to the coupler 410. However, in some embodiments, the position of the traces of the coupler 410 may differ from those of the coupler 400. Generally, the trace 412 and the trace 414 are positioned relative to each other in the same vertical plane such that the main arm 405 of the trace 402 is aligned below trace 414 with a gap width between the two traces, similar to the GAP W depicted in FIG. 3B. However, in some embodiments, the position of the trace 414 may be adjusted relative to the position of the main arm 415 of the trace 412. Further, in some embodiments, the main arm 405 of the trace 402 may be aligned above the trace 414.

Generally, the main arm of the trace 412 and the trace 414 are equal in size. However, in some embodiments, the main arm of the trace 412 and the trace 414 may differ in size. For example, the length and/or the width of the main arm 415 of the trace 412 may differ from the length and/or width of the trace 414.

Example of an Embedded Capacitor Coupler

Figure 5:
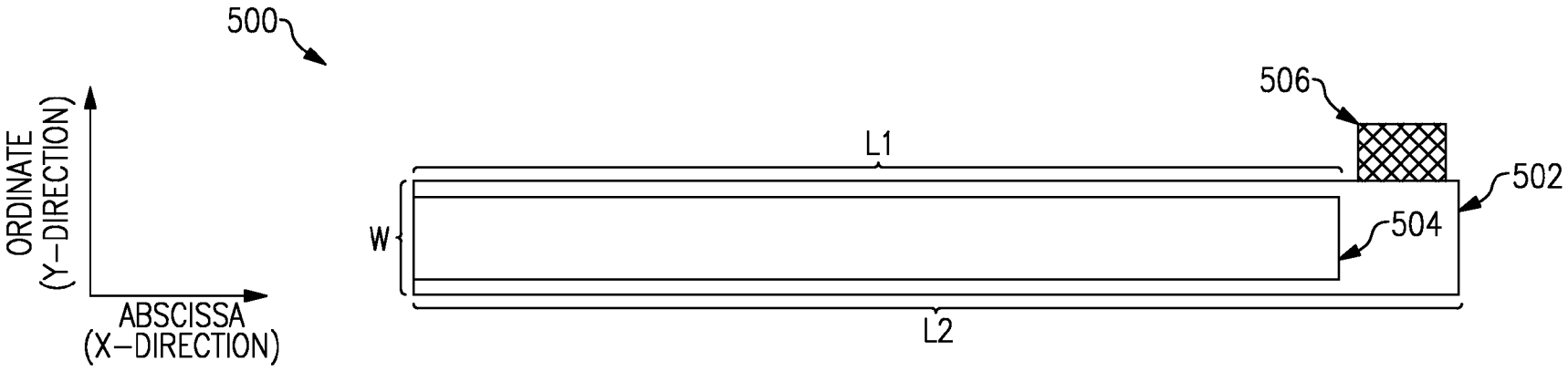
FIG. 5 illustrates an embodiment of an embedded capacitor coupler in accordance with the present disclosure.

FIG. 5 illustrates an embodiment of an embedded capacitor coupler 500 in accordance with the present disclosure. The coupler 500 includes two traces 502 and 504. Both traces have a width W. The trace 502 has a length L2 and the trace 504 has a length L1. In some embodiments, the lengths of the two traces are equal. Further, the coupler 500 includes an embedded capacitor 506. In some embodiments the capacitor 506 may be a floating capacitor.

Although only a single capacitor is depicted, in some embodiments multiple capacitors may be used. For example, a capacitor may be connected to the trace 504 as well as the trace 502. Further, a capacitor may be connected to each end of one or both of the traces.

Advantageously, in some embodiments, by adjusting the number of capacitors, the type of capacitors, and the specifications of the capacitors trace, a discontinuity is created in the coupler 500 resulting in a mismatch. Further, by adjusting the discontinuity through the choice of capacitor, the equivalent directivity can be increased for a given coupling factor while improving the coupling factor variation as calculated using equations 6, 4 and 5 respectively for a target operating frequency.

Generally, the trace 502 and the trace 504 are positioned relative to each other in the same vertical plane such that the trace 502 is aligned below the trace 504 with a gap width between the two traces, similar to the GAP W depicted in FIG. 3B. However, in some embodiments, the position of the trace 504 may be adjusted relative to the position of the trace 502. Further, in some embodiments, the trace 502 may be aligned above the trace 504. In some embodiments, the trace 504 and the trace 504 may be aligned in the same horizontal place with a width between the two traces similar to the coupler depicted in FIG. 2A.

As with the previously described couplers, each trace may be associated with two ports (not shown). For example, the trace 502 may be associated with an input port on the left end (the side with the label W) and an output port on the right end (the side with the capacitor 506) of the trace 502. Likewise, the trace 504 may be associated with a coupled port on the left end and an isolated port on the right end of the trace 504. Of course, in some embodiments, the ports may be swapped such that the input port and the coupled port are on the right while the output port and the isolated port are on the left of the traces. In some embodiments, the coupled port may be on the right end and the isolated port may be on the left end of the trace 504, while the input port remains on the left end of the trace 502 and the output port remains on the right end of the trace 502. Further, in certain embodiments, the input port and the output port may be associated with the trace 504 and the coupled port and the isolated port may be associated with the trace 502. In certain embodiments, the traces 502 and 504 are connected with the ports by connecting traces (not shown). In some embodiments, the traces communicate with the ports by the use of vias that connect the main arms of the traces with the ports.

Although much of the description of the previously described couplers have focused on the conductive traces of the coupler, it should be understood that each of the coupler designs are part of a coupler module that may include one or more dielectric layers, substrates, and packaging. For instance, one or more of the couplers 300, 310, 320, 410, and 500 may include a dielectric material between each of the illustrated traces. As a second example, the traces of one or more of the couplers 200, 210, 220, and 400 may be formed on a substrate. Further, although generally the conductive traces are made of the same conductive material, such as copper, in some embodiments one trace may be made of a different material than the second trace.

Example of an Electronic Device with a Coupler

Figure 6:
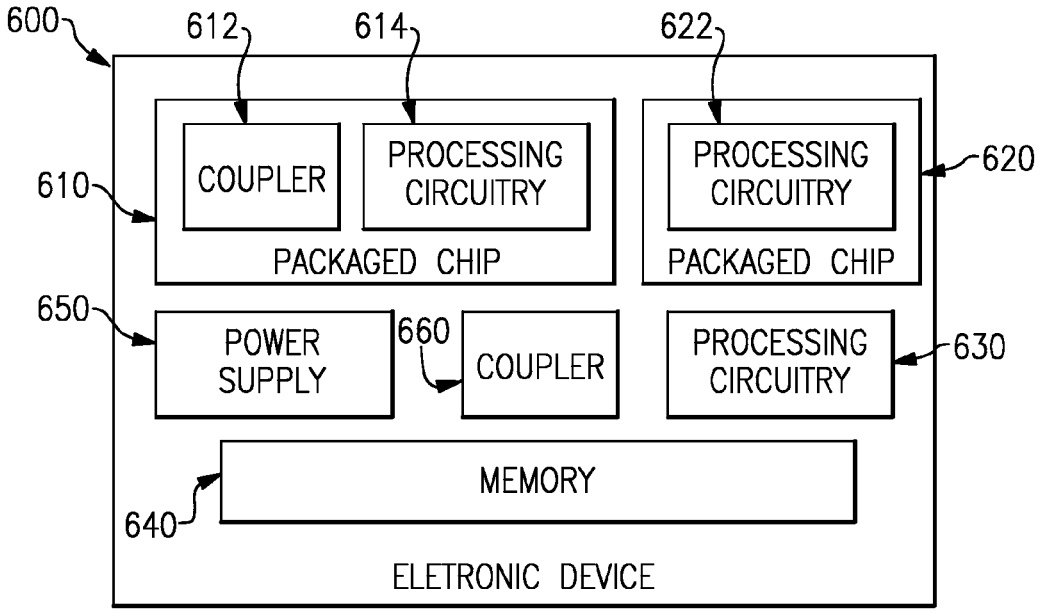
FIG. 6 illustrates an embodiment of an electronic device including a coupler in accordance with the present disclosure.

FIG. 6 illustrates an embodiment of an electronic device 600 including a coupler in accordance with the present disclosure. The electronic device 600 can generally include any device that may use a coupler. For example, the electronic device 600 may be a wireless phone, a base station, or a sonar system, to name a few.

The electronic device 600 can include a packaged chip 610, a packaged chip 622, processing circuitry 630, memory 640, a power supply 650, and a coupler 660. In some embodiments, the electronic device 600 may include any number of additional systems and subsystems, such as a transceiver, a repeater, or an emitter, to name a few. Further, some embodiments may include fewer systems than illustrated in FIG. 6.

The packaged chips 610 and 620 can include any type of packaged chip that may be used with an electronic device 600. For example, the packaged chips can include digital signal processors. The packaged chip 610 can include a coupler 612 and processing circuitry 614. Further, the packaged chip 620 can include processing circuitry 622. In addition, each of the packaged chips 610 and 620 may include memory. In some embodiments, the packaged chip 610 and the packaged chip 620 may be of any size. In certain embodiments, the packaged chip 610 may be 3 mm×3 mm. In other embodiments, the packaged chip 610 may be smaller than 3 mm×3 mm.

The processing circuitry 614, 622, and 630 may include any type of processing circuitry that may be associated with the electronic device 600. For example, the processing circuitry 630 may include circuitry for controlling the electronic device 600. As a second example, the processing circuitry 614 may include circuitry for performing signal conditioning of received signals and/or signals intended for transmission prior to their transmission. The processing circuitry 622 may include, for example, circuitry for graphics processing and for controlling a display (not shown) associated with the electronic device 600. In some embodiments, the processing circuitry 614 may include a power amplifier module (PAM).

The couplers 612 and 660 may include any of the couplers previously described in accordance with this disclosure. Further, the coupler 612 may be designed in accordance with this disclosure to fit within a 3 mm×3 mm packaged chip 610.

First Example of a Coupler Manufacturing Process

Figure 7:
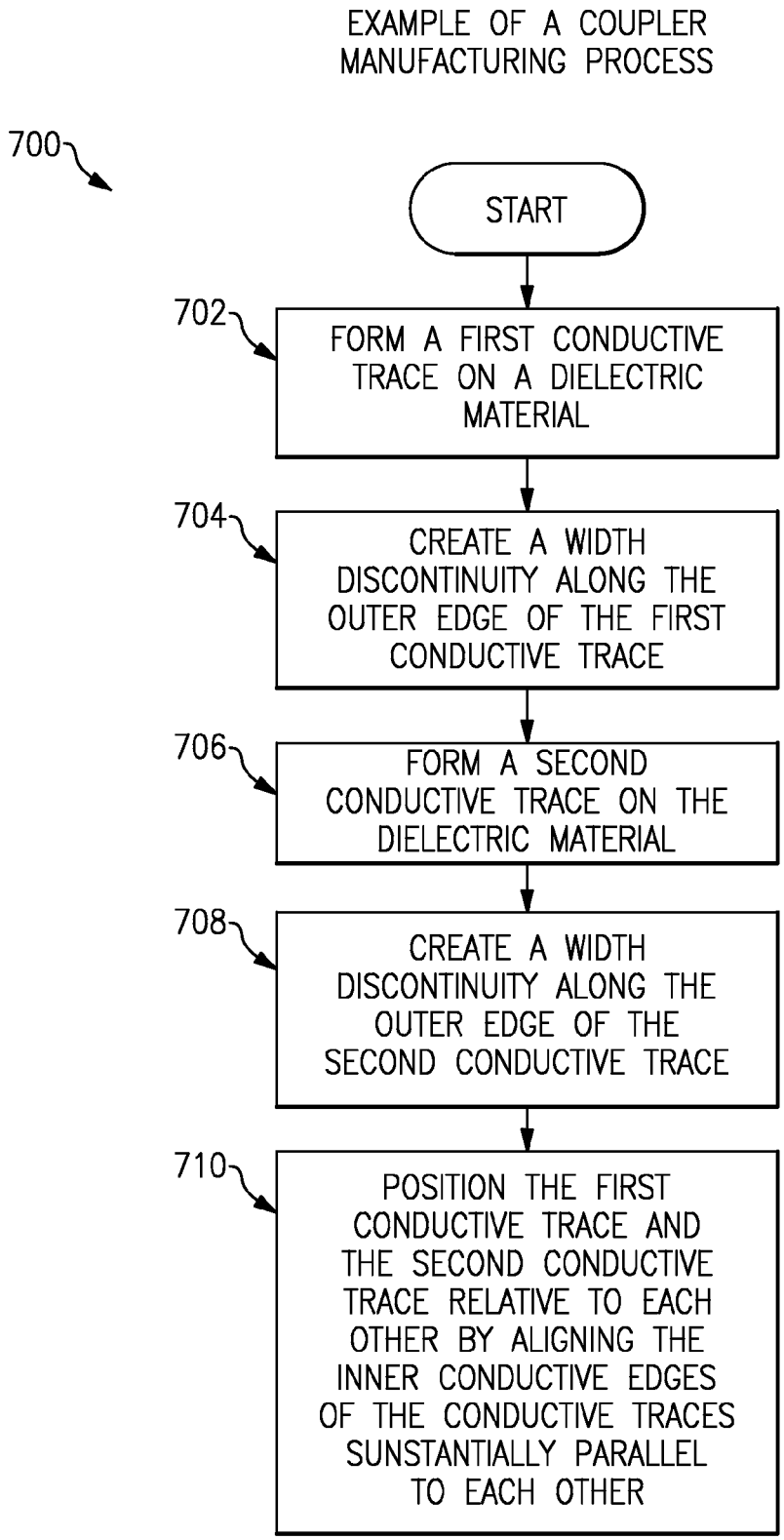
FIG. 7 illustrates a flow diagram for one embodiment of a coupler manufacturing process in accordance with the present disclosure.

FIG. 7 illustrates a flow diagram for one embodiment of a coupler manufacturing process 700 in accordance with the present disclosure. The process 700 may be performed by any system capable of creating a coupler in accordance with the present disclosure. For example, the process 700 may be performed by a general purpose computing system, a special purpose computing system, by an interactive computerized manufacturing system, by an automated computerized manufacturing system, or a semiconductor manufacturing system to name a few. In some embodiments, a user controls the system implementing the manufacturing process.

The process begins at block 702, where a first conductive trace is formed on a dielectric material. The first conductive trace can be made using a number of conductive materials as is understood by a person of ordinary skill in the art. For example, the conductive trace may be made of copper. Further, the dielectric material may include a number of dielectric materials as is understood by a person of ordinary skill in the art. For example, the dielectric material may be a ceramic or a metal oxide. In certain embodiments, the dielectric material is located on a substrate that may be located on a ground plane. In one embodiment, the first conductive trace may be formed on an insulator.

At block 704, the process 700 includes creating a width discontinuity along the outer edge of the first conductive trace. Although identified separately, the operation associated with the block 704 may be included as part of the block 702. In certain embodiments, creating the width discontinuity includes creating a segment of the first trace with a greater width than the remainder of the first trace, such as the coupler 210 illustrated in FIG. 2C. Alternatively, creating the width discontinuity includes creating a segment of the first trace with a narrower width than the remainder of the first trace, such as the coupler 220 illustrated in FIG. 2D. Further, this width discontinuity may be located substantially at the center of the trace, as illustrated in FIGS. 2C and 2D. Alternatively, the width discontinuity may be created off-center, including at an end of the first trace.

In certain embodiments, the angle created between the segment of the first trace with the greater width (or narrower width) and the remainder of the first trace is substantially 90 degrees. However, in some embodiments, the angle may be less than or greater than 90 degrees. In some embodiments, the angle on each side of the segment with the greater (or narrower) width compared to the remainder of the first trace is substantially equal. In other embodiments, the angle on each side may differ.

At block 706, a second conductive trace is formed on the dielectric material. At block 708, a width discontinuity is created along the outer edge of the second conductive trace. In certain embodiments, the second conductive trace is substantially identical to the first conductive trace, but is a mirror image of the first conductive trace. However, in some embodiments, the width discontinuity created along the outer edge of the second conductive trace may vary from the width discontinuity created at block 704 along the first conductive trace. Generally, the various embodiments described above with respect to the blocks 702 and 704 apply to the blocks 706 and 708.

At block 710, the first conductive trace and the second conductive trace are positioned relative to each other by aligning the inner conductive edges of the conductive traces substantially parallel to each other, such as illustrated in FIGS. 2C and 2D. Although identified separately, the operation associated with the block 710 may be included as part of one or more of the blocks 702 and 706 as the traces are formed. In some embodiments, the first trace and the second trace are aligned such that both traces begin at the same point in the abscissa direction and end at the same point in the abscissa direction, as illustrated in FIGS. 2C and 2D. Alternatively, the traces may be aligned off-center such that the first trace and the second trace start and end at different positions in the abscissa direction.

In some embodiments, a space or gap is maintained between the first conductive trace and the second conductive trace at block 710. As is understood by a person of ordinary skill in the art, this gap is selected to enable a desired coupling to the second trace of a desired portion of the power applied to the first trace.

In certain embodiments, the first conductive trace and the second conductive trace are aligned in the same horizontal plane, as illustrated in FIG. 2B for example. Alternatively, the traces may be in different planes.

In certain additional embodiments, the dimensions of the first trace and the second trace, including the different segments of the traces, are selected to maximize the equivalent directivity for a given coupling factor while minimizing the coupling factor variation as calculated using equations 6, 4 and 5 respectively for a target operating frequency. Further, in some embodiments, the dimensions are selected to enable the coupler to fit within a 3 mm×3 mm package.

Second Example of a Coupler Manufacturing Process

Figure 8:
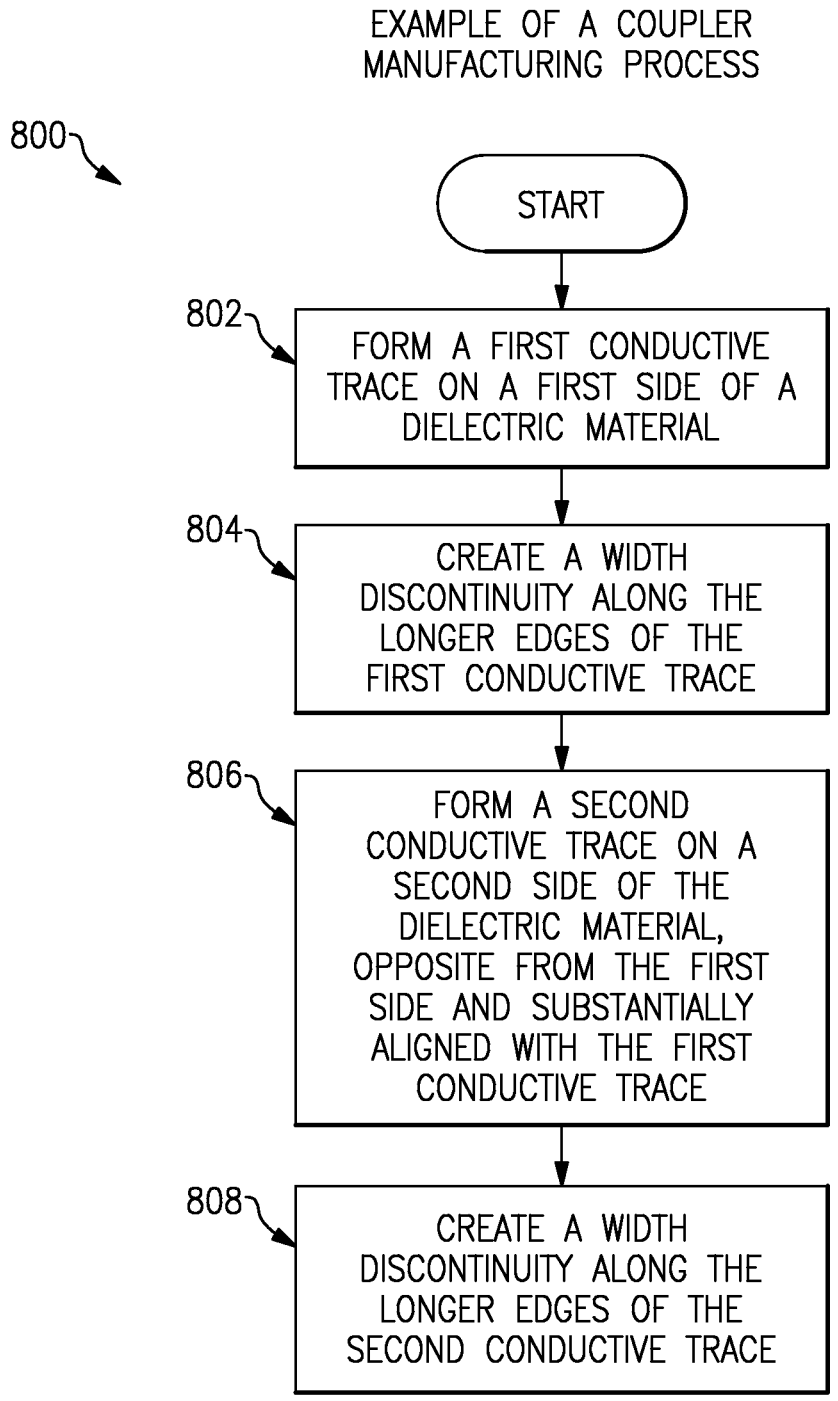
FIG. 8 illustrates a flow diagram for one embodiment of a coupler manufacturing process in accordance with the present disclosure.

FIG. 8 illustrates a flow diagram for one embodiment of a coupler manufacturing process 800 in accordance with the present disclosure. The process 800 may be performed by any system capable of creating a coupler in accordance with the present disclosure. For example, the process 800 may be performed by a general purpose computing system, a special purpose computing system, by an interactive computerized manufacturing system, by an automated computerized manufacturing system, or a semiconductor manufacturing system to name a few. In some embodiments, a user controls the system implementing the manufacturing process.

The process begins at block 802, where a first conductive trace is formed on a first side of a dielectric material. The first conductive trace can be made using a number of conductive materials as is understood by a person of ordinary skill in the art. For example, the conductive trace may be made of copper. Further, the dielectric material may include a number of dielectric materials as is understood by a person of ordinary skill in the art. For example, the dielectric material may be a ceramic or a metal oxide. In one embodiment, the first conductive trace may be formed on an insulator.

At block 804, a width discontinuity is created along each of the longer edges (those along the abscissa as depicted in FIGS. 3C and 3D) of the first conductive trace. Although identified separately, the operation associated with the block 804 may be included as part of the block 802. In certain embodiments, creating the width discontinuity includes creating a segment of the first trace with a greater width than the remainder of the first trace by extending the segment of the trace in the ordinate direction on each side of the first trace, such as the coupler 310 illustrated in FIG. 3C. Alternatively, creating the width discontinuity includes creating a segment of the first trace with a narrower width than the remainder of the first trace by reducing the width of the segment in the ordinate direction on each side of the first trace, such as the coupler 320 illustrated in FIG. 3D. Further, this width discontinuity may be located substantially at the center of the trace, as illustrated in FIGS. 3C and 3D. Alternatively, the width discontinuity may be created off-center, including at an end of the first trace.

In certain embodiments, the dimensions of the segment with the greater (or narrower) width on one side of the first trace are substantially equal to the dimensions of the corresponding segment on the other side of the first trace. In other embodiments, the dimensions of the segments with the greater (or narrower) width may differ on each side of the first trace. For example, one segment may be longer. As a second example, the segment with the greater width on one side of the first trace may extend further than the segment with the greater width on the other side of the first trace.

In certain further embodiments, the angle created between the segment of the first trace with the greater width (or narrower width) and the remainder of the first trace is substantially 90 degrees. However, in some embodiments, the angle may be less than or greater than 90 degrees. In some embodiments, the angle on each side of the segment with the greater (or narrower) width compared to the remainder of the first trace is substantially equal. In other embodiments, the angle on each side of the segment may differ. Further, in some embodiments, one or more of the angles associated with the segment with the great (or narrower) width on one side of the first trace is equal to one or more of the angles associated with the segment on the other side of the first trace. In other embodiments, one or more of the angles may differ.

At block 806, a second conductive trace is formed on a second side of the dielectric material opposite from the first side of the dielectric material and substantially aligned with the first conductive trace. In some embodiments, the second trace is formed on a second side of an insulator opposite from the first side of the insulator that includes the first trace.

In certain embodiments, the second conductive trace is formed on a second dielectric material (or a second insulator) positioned above or below the first dielectric material (or first insulator). In certain embodiments, the two layers of dielectric material may be separated by another material, such as an insulator, or by air. In other embodiments, the first and second conductive traces may be embedded within a dielectric material with a layer of the dielectric material located between the two conductive traces. In certain embodiments, the dielectric material may be between a pair of ground planes, which may each be on a substrate.

At block 808, a width discontinuity is created along each of the longer edges (those along the abscissa as depicted in FIGS. 3C and 3D) of the second conductive trace. Although identified separately, the operation associated with the block 808 may be included as part of the block 806.

In certain embodiments, the second conductive trace is substantially identical to the first conductive trace. However, in some embodiments, the width discontinuities created along each of the longer edges of the second conductive trace may vary from the width discontinuities created at block 804 along each of the longer edges of the first conductive trace. Generally, the various embodiments described above with respect to the blocks 802 and 804 apply to the blocks 806 and 808.

In certain embodiments, the second conductive trace is positioned relative to the first conductive trace, with one trace centered above the other trace in the same vertical plane. In some embodiments, the first conductive trace and the second conductive trace are aligned in different planes. In some embodiments, the first trace and the second trace are aligned such that both traces begin at the same point in the abscissa direction and end at the same point in the abscissa direction, as illustrated in FIGS. 3C and 3D. Alternatively, the traces may be aligned off-center such that the first trace and the second trace start and end at different positions in the abscissa direction.

In some embodiments, a separation or gap is maintained between the first conductive trace and the second conductive trace. As is understood by a person of ordinary skill in the art, this gap is selected to enable a desired coupling to the second trace of a desired portion of the power applied to the first trace. Although in some embodiments the gap may be filled with air, in a number of embodiments, the gap is filled with a dielectric material or an insulator.

In certain embodiments, the dimensions of the first trace and the second trace, including the different segments of the traces, are selected to maximize the equivalent directivity for a given coupling factor while minimizing the coupling factor variation as calculated using equations 6, 4 and 5 respectively for a target operating frequency. Further, in some embodiments, the dimensions are selected to enable the coupler to fit within a 3 mm×3 mm package.

Third Example of a Coupler Manufacturing Process

Figure 9:
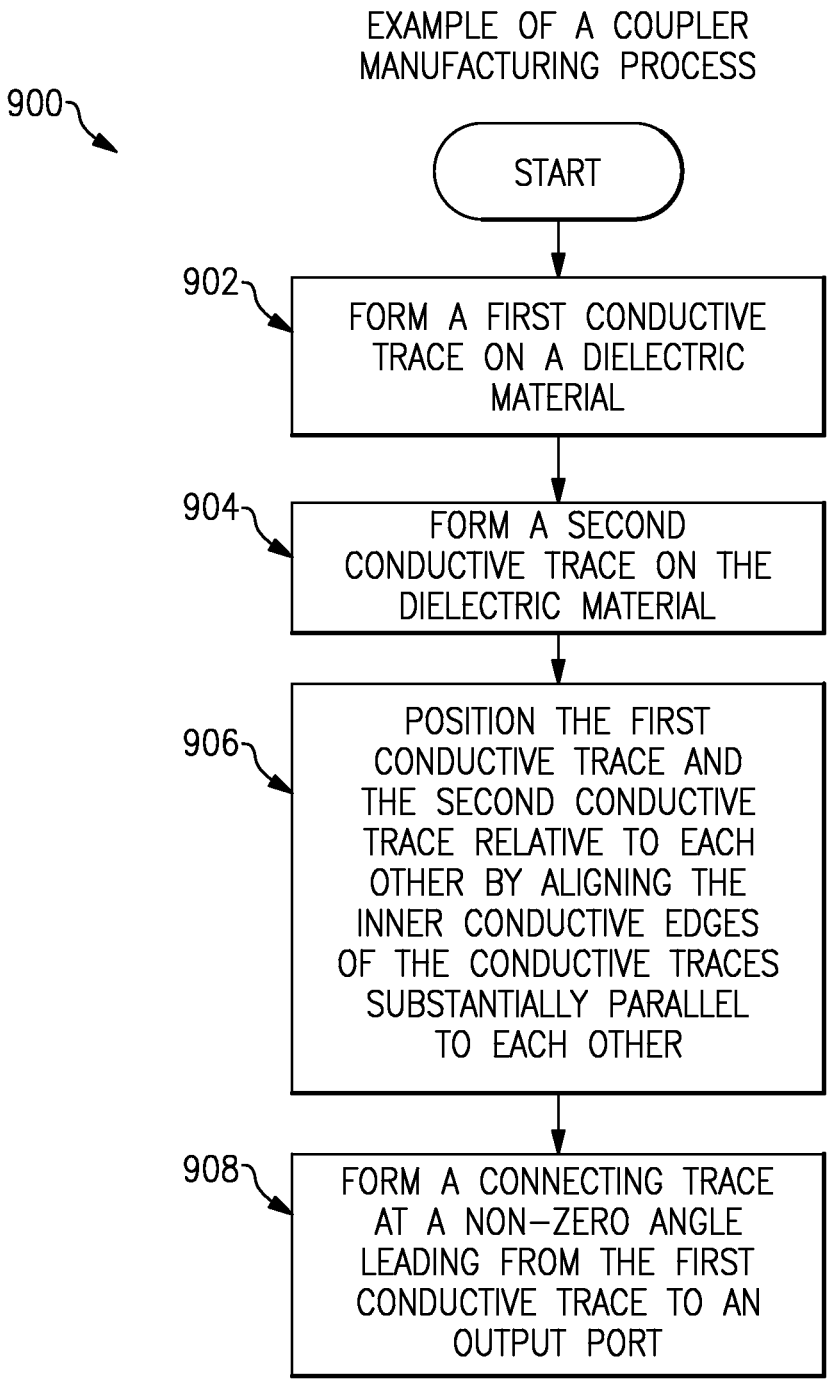
FIG. 9 illustrates a flow diagram for one embodiment of a coupler manufacturing process in accordance with the present disclosure.

FIG. 9 illustrates a flow diagram for one embodiment of a coupler manufacturing process 900 in accordance with the present disclosure. The process 900 may be performed by any system capable of creating a coupler in accordance with the present disclosure. For example, the process 900 may be performed by a general purpose computing system, a special purpose computing system, by an interactive computerized manufacturing system, by an automated computerized manufacturing system, or a semiconductor manufacturing system to name a few. In some embodiments, a user controls the system implementing the manufacturing process.

The process begins at block 902, where a first conductive trace is formed on a dielectric material. The first conductive trace can be made using a number of conductive materials as is understood by a person of ordinary skill in the art. For example, the conductive trace may be made of copper. Further, the dielectric material may include a number of dielectric materials as is understood by a person of ordinary skill in the art. For example, the dielectric material may be a ceramic or a metal oxide. In one embodiment, the first conductive trace may be formed on an insulator.

At block 904, a second conductive trace is formed on the dielectric material. At block 906, the first conductive trace and the second conductive trace are positioned relative to each other by aligning the inner conductive edges of the conductive traces substantially parallel to each other, such as illustrated in FIG. 4A. In some embodiments, the first trace and the second trace are aligned such that at least one end of both traces begin at the same point in the abscissa direction, as illustrated in FIG. 4A. Alternatively, the traces may be aligned such that the first trace and the second trace start and end at different positions in the abscissa direction.

In some embodiments, a space or gap is maintained between the first conductive trace and the second conductive trace. As is understood by a person of ordinary skill in the art, this gap is selected to enable a desired coupling to the second trace of a desired portion of the power applied to the first trace.

In certain embodiments, the first conductive trace and the second conductive trace are aligned in the same horizontal plane, as illustrated in FIG. 2B for example. Alternatively, the traces may be in different planes.

In further embodiments, the second conductive trace is positioned relative to the first conductive trace, with one trace centered above the other trace in the same vertical plane, as illustrated in FIG. 4B for example. In some embodiments, the first conductive trace and the second conductive trace are aligned in different planes. Further, some or all of the embodiments described with respect to the process 800 for positioning the two conductive traces may apply to the process 900.

At block 908, a connecting trace is formed at a non-zero angle leading from the first conductive trace, or the main trace of the first conductive trace, to an output port. In some embodiments, the connecting trace leads from the second conductive trace, or the main trace of the second conductive trace, to an output port. In certain embodiments, a first connecting trace may be formed for one conductive trace leading to the output port, and a second connecting trace may be formed for the other conductive trace leading to one of the coupled port and the isolated port. Each connecting trace may be formed at a non-zero angle to its respective conducting trace.

In some embodiments, between one and three connecting traces may lead from the first and second conductive traces to the coupler's ports. At least one of the connecting traces is formed at a non-zero angle to its respective conductive trace.

In certain embodiments, four connecting traces may lead from the first and second conductive traces to the coupler's four ports. At least one of the connecting traces is formed at a non-zero angle to its respective conductive trace and at least one of the connecting traces is formed at a zero-degree angle to its respective conductive trace.

In certain further embodiments, as previously described, the connecting traces may have the same width as the main traces of the conducting traces. Alternatively, the connecting traces may have a different width. In some embodiments, the connecting trace may have the same width as the main trace at the point where the main trace and the connecting trace join. The connecting width may then narrow or broaden as it is formed towards the associated port, such as the output port.

In certain embodiments, the dimensions of the connecting trace and the non-zero angle at which the connecting trace joins to the main trace of the conducting trace are selected to maximize the equivalent directivity for a given coupling factor while minimizing the coupling factor variation as calculated using equations 6, 4 and 5 respectively for a target operating frequency. Further, in some embodiments, the dimensions are selected to enable the coupler to fit within a 3 mm×3 mm package.

Fourth Example of a Coupler Manufacturing Process

Figure 10:
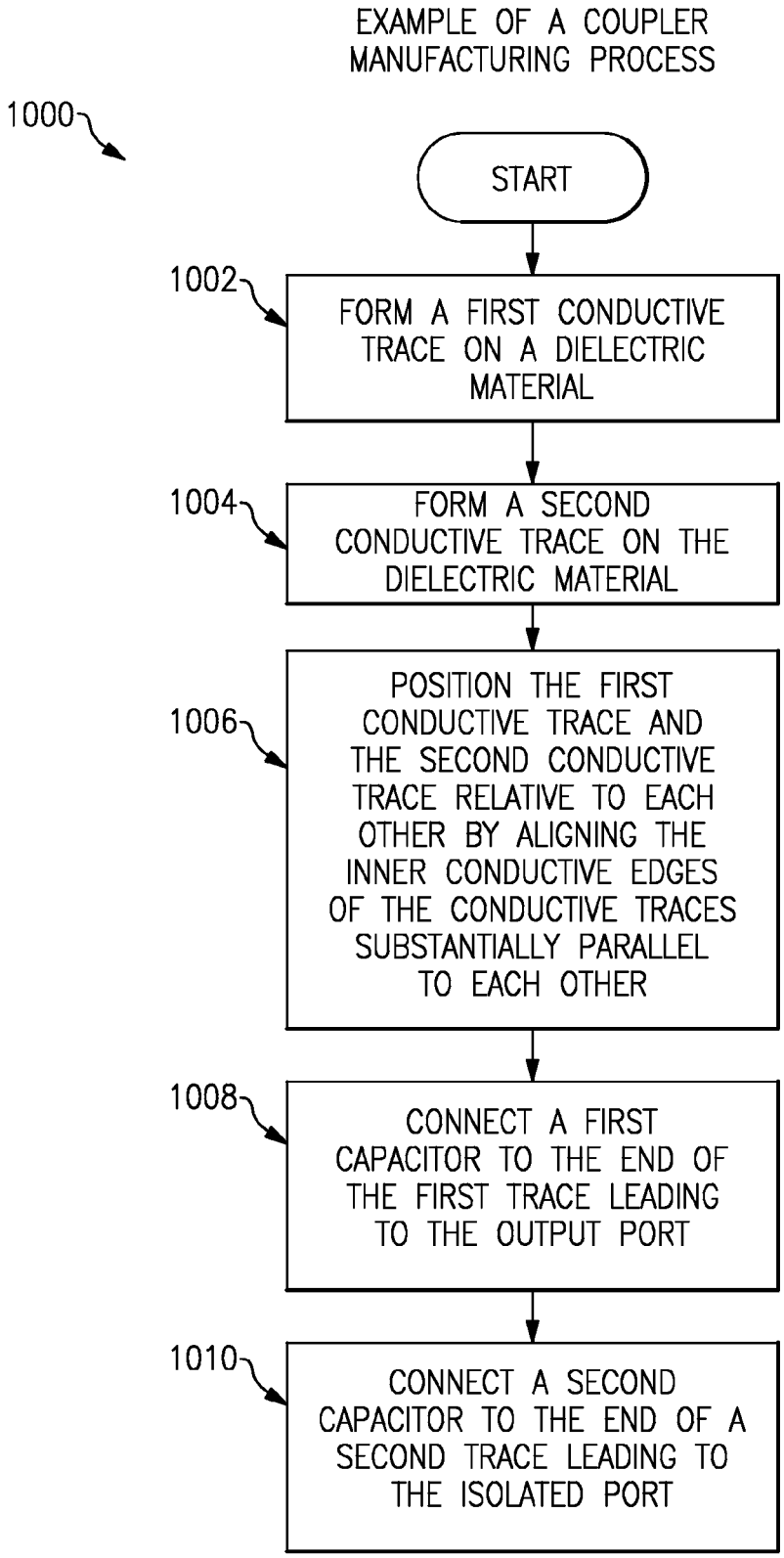
FIG. 10 illustrates a flow diagram for one embodiment of a coupler manufacturing process in accordance with the present disclosure.

FIG. 10 illustrates a flow diagram for one embodiment of a coupler manufacturing process 1000 in accordance with the present disclosure. The process 1000 may be performed by any system capable of creating a coupler in accordance with the present disclosure. For example, the process 1000 may be performed by a general purpose computing system, a special purpose computing system, by an interactive computerized manufacturing system, by an automated computerized manufacturing system, or a semiconductor manufacturing system to name a few. In some embodiments, a user controls the system implementing the manufacturing process.

The process begins at block 1002, where a first conductive trace is formed on a dielectric material. The first conductive trace can be made using a number of conductive materials as is understood by a person of ordinary skill in the art. For example, the conductive trace may be made of copper. Further, the dielectric material may include a number of dielectric materials as is understood by a person of ordinary skill in the art. For example, the dielectric material may be a ceramic or a metal oxide. In one embodiment, the first conductive trace may be formed on an insulator.

At block 1004, a second conductive trace is formed on the dielectric material. At block 1006, the first conductive trace and the second conductive trace are positioned relative to each other by aligning the inner conductive edges of the conductive traces substantially parallel to each other, such as illustrated in FIG. 4A. In some embodiments, the first trace and the second trace are aligned such that at least one end of both traces begin at the same point in the abscissa direction, as illustrated in FIG. 4A. Alternatively, the traces may be aligned such that the first trace and the second trace start and end at different positions in the abscissa direction.

In some embodiments, a space or gap is maintained between the first conductive trace and the second conductive trace. As is understood by a person of ordinary skill in the art, this gap is selected to enable a desired coupling to the second trace of a desired portion of the power applied to the first trace.

In certain embodiments, the first conductive trace and the second conductive trace are aligned in the same horizontal plane, as illustrated in FIG. 2B for example. Alternatively, the traces may be in different planes.

In some embodiments, the second conductive trace is positioned relative to the first conductive trace, with one trace centered above the other trace in the same vertical plane, as illustrated in FIG. 5 for example. In some embodiments, the first conductive trace and the second conductive trace are aligned in different planes. Further, some or all of the embodiments described with respect to the process 800 for positioning the two conductive traces may apply to the process 1000.

At block 1008, a first capacitor is connected to the end of the first trace leading to the output port of the conductor. At block 1010, a second capacitor is connected to the end of the second trace leading to the isolated port. Alternatively, the second capacitor may be connected to the end of the second trace leading to the coupled port. In some embodiments, block 1010 is optional. In some embodiments, a first capacitor is connected at the end of the second trace leading to one of the coupled port and the isolated port without a second capacitor connected to the first trace.

In certain embodiments, the capacitor and/or the second capacitor are embedded capacitors. In some embodiments, the capacitor and/or the second capacitor are floating capacitors.

In certain embodiments, the characteristics of the capacitor and/or second capacitor are selected to maximize the equivalent directivity for a given coupling factor while minimizing the coupling factor variation as calculated using equations 6, 4 and 5 respectively for a target operating frequency. Further, in some embodiments, the characteristics of the capacitor and/or second capacitor are selected to enable the coupler to be reduced in size sufficiently to fit within a 3 mm×3 mm package. In a number of implementations, the characteristics of the capacitor can include any characteristics associated with a capacitor or the placement of the capacitor. For example, the characteristics can include the value of the capacitor, or its capacitance, the geometry of the capacitor, the placement of the capacitor relative to one or both traces of the coupler, the placement of the capacitor relative to one or more of the ports of the coupler, and the placement of the capacitor relative to other components in communication with the coupler, to name a few.

Experimental Results for an Edge Strip Coupler

A number of designs were simulated and tested for each of the coupler designs disclosed herein. Two of these designs are based on the embodiment illustrated in FIG. 2C. The results for these designs are identified as "Design 2" and Design 3" in Table 1 below. The results listed for "Design 1" in Table 1 below are for a comparison example based on FIG. 2A.

TABLE 1

| | Directivity (dB) | Equivalent Directivity (dB) | Coupling Factor (dB) | $S_{22}$ (dB) |
|---|---|---|---|---|
| Design 1 | 23 | 23 | 20 | −33 |
| Design 2 | 27 | 30 | 20 | −29 |
| Design 3 | 27 | 55 | 20 | −27 |

The three designs each have a target frequency of 782 MHz and are designed on a 4-layer substrate with a 50 um spacing or gap width between the two traces. The widths at the ends of the traces, W in FIG. 2A for Design 1 and W1 in FIG. 2C for Designs 2 and 3, for all three designs is 1000 um. The length of the two traces, L in FIG. 2A for Design 1 is 8000 um. For Designs 1 and 2, the length of the three segments of the two traces are as follows: L1 is 1500 um, L2 is 4400 um, and L3 is 2100 um. Thus, as with Design 1, the total length of each of the two traces in Designs 1 and 2 is also 8000 um. In addition, the designs were created to have a coupling factor of 20 dB. Thus, the difference between the three designs is in the center-width of the two traces, and in the length, L3 in FIG. 2C, of the center segments.

For Design 1, the comparison example, the center-width is the same as the width at the end of the traces, 1000 um, as the traces remain uniform over the entire length of the traces. The selection of these physical dimensions results in a Directivity of 23 dB, with a similar equivalent directivity of 23 dB. For Design 2, the center-width, the summation of W1 and W2 in FIG. 2C, is 1200 um. Thus, the width W2 is 200 um. As can be seen from Table 1, by introducing the discontinuity, the equivalent directivity, as calculated from equation 6, increases to 30 dB, an improvement of 3 dB over the 27 dB directivity for Design 2. Moreover, comparing Design 1 and Design 2, the reflection at the output port, $S_{22}$, increases from −33 dB to −29 dB. This increase reduces the peak-to-peak error, or the coupling factor variation, as calculated using equation 5.

As can be seen from Table 1, Design 3 provides improved results over both Design 1 and Design 2. As described above, Design 3 shares a number of design features with Design 2. However, Design 3 has a center-width of 1400 um. Thus, the width W2 for Design 3 is 400 um. With the center width increasing, reflection at the output port of the main arm becomes higher, $S_{22}$ increases to −27 dB, and the equivalent directivity, benefiting from the cancellation effect caused by the intended mismatch, increases to 55 dB. Thus, as can be seen from Table 1, introducing mismatch through a discontinuity in the center width of the traces improves directivity while reducing coupling factor variation for a target operating frequency.

Experimental Results for a Layered Angled Coupler

Figure 11A:
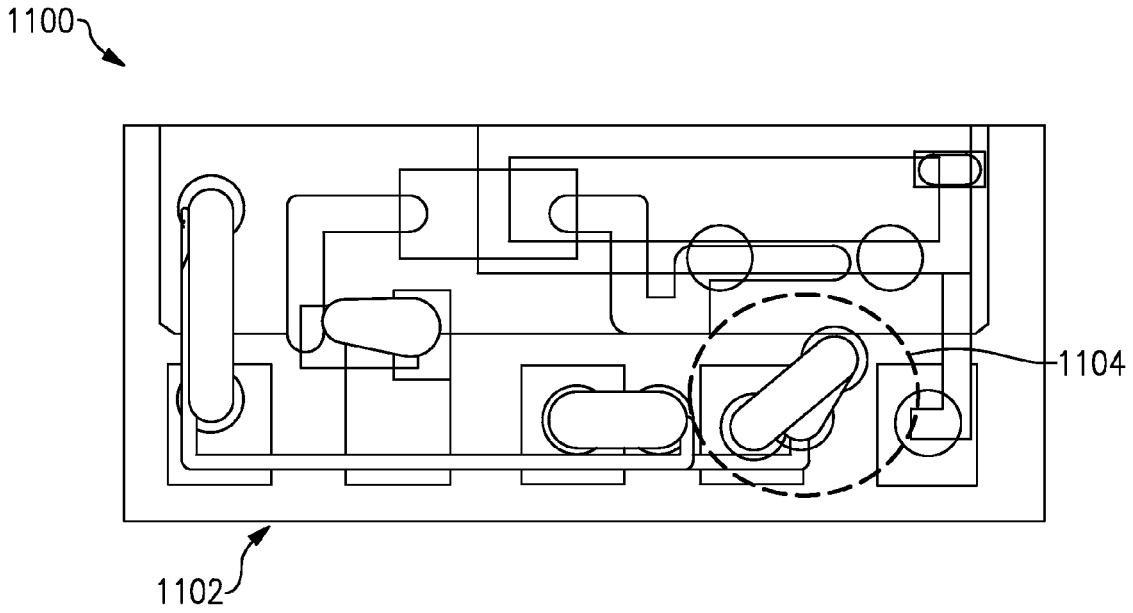
FIG. 11A illustrates an embodiment of a prototype PAM that includes a layered angled coupler in accordance with the present disclosure.
Figure 11B:
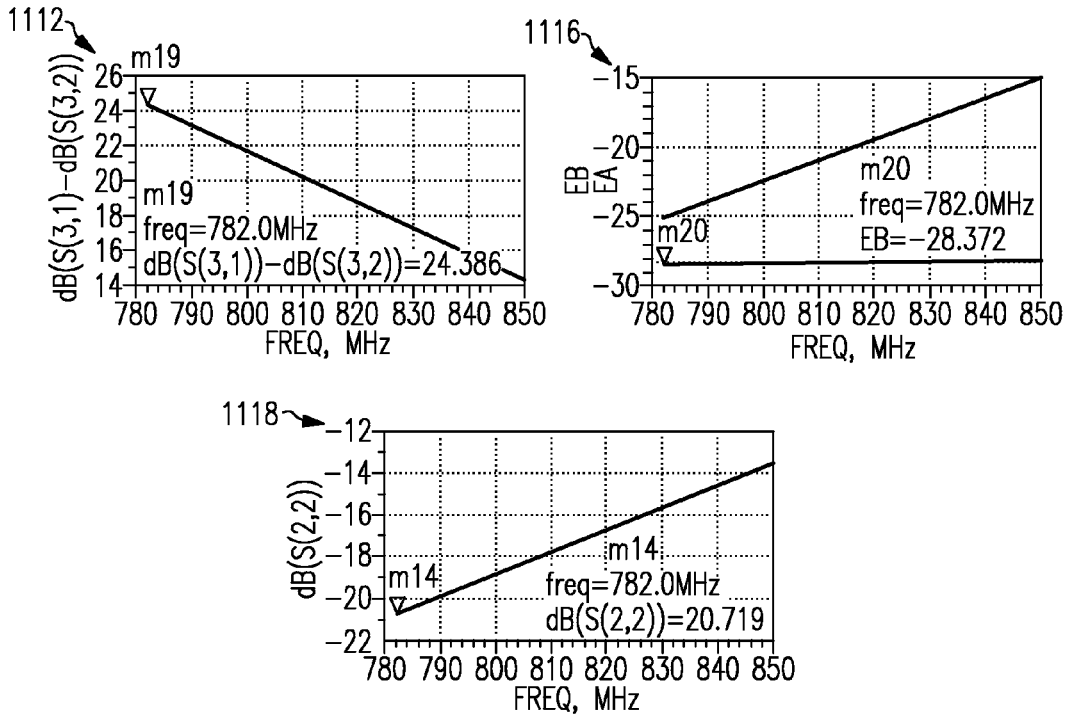
FIGS. 11B-C illustrate measured results and simulated results for the coupler included in the prototype of FIG. 11A.
Figure 11C:
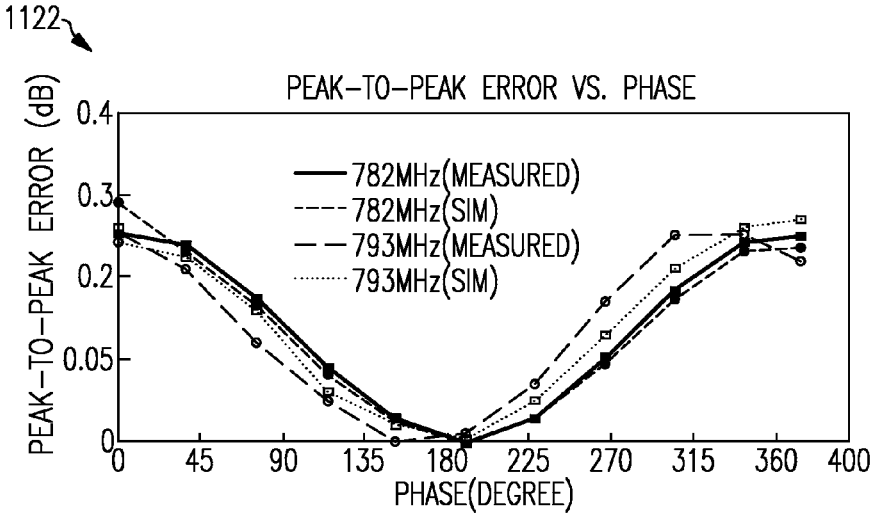

FIGS. 11A illustrates an embodiment of a 3 mm×3 mm PAM that uses a layered angled coupler in accordance with the present disclosure. Further, FIGS. 11B-C illustrate both measured and simulated results for the coupler used with the PAM of FIG. 11A. FIG. 11A illustrates a PAM 1100 with a VSWR 2.5:1. The PAM 1100 includes a layered angled coupler 1102. As can be seen from FIG. 11A, the coupler 1102 is similar in design to that described with respect to FIG. 4B. The first trace, the bottom trace, of the coupler 1102 is connected to the output port with the use of a pair of angled connecting traces 1104. The first connecting trace connects the main arm to a via leading to another layer. The second connecting trace leads from the via to another via in yet another layer. Although the PAM 1100 illustrates two connecting traces for the coupler 1102, in certain embodiments, one or more connecting traces may be used to connect the main arm of a conducting trace to the output port. In a number of implementations, the predominant impact on directivity and coupling factor variation is a result of the angle between the first connecting trace and the main arm. However, in some embodiments, the angle between the first connecting trace and additional connecting traces may also affect the values of the directivity and coupling factor variation for the coupler 1102. Similarly, in some embodiments, the angle between the connecting trace and the port may affect the values of the directivity and coupling factor variation for the coupler 1102.

In the illustrated coupler 1102 of FIG. 11A, the optimum angle of connection between the first connecting trace or connecting arm and the main arm was determined to be 145 degrees for the coupler 1102. This value was determined by sweeping the angle between 45 and 165 degrees. In certain embodiments, the optimum angle may differ from the angle determined for the coupler 1102.

As with the couplers described in the previous section, the coupler 1102 was created on a 4-layer substrate and was designed for a frequency of 782 MHz. The orientation of the connecting traces 1104 between the arms and the vias was adjusted to obtain a high equivalent directivity as can be seen from the graphs of FIG. 11B. Graph 1112 and graph 1116 depict coupler directivity for a coupler without angled connecting traces and for coupler 1102 respectively. As can be seen from the two graphs, the coupler directivity improves from 24.4 dB to 28.4 dB with an output return loss of −20.7 dB as illustrated in graph 1118.

Referring to FIG. 11C, it can be seen from graph 1122 that the peak-to-peak error measurement for the PAM with VSWR 2.5:1 shows a 0.3 dB variation. Thus, although an intentional mismatch is introduced, the same coupling factor variation is achieved as is expected for a matched 28 dB coupler.

Experimental Results for an Embedded Capacitor Coupler

Figure 12A:
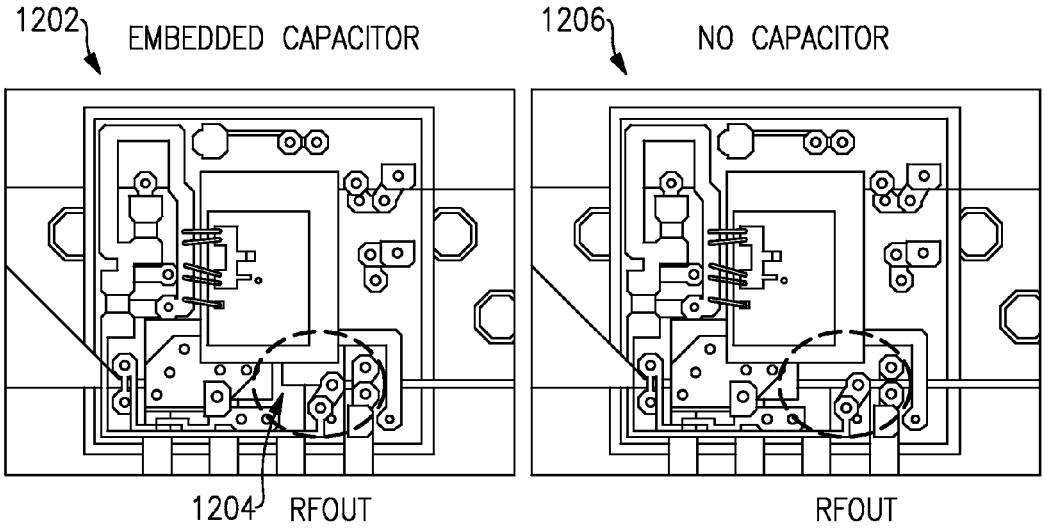
FIGS. 12A-B illustrate an example simulated design and comparison design, and simulation results for an embedded capacitor coupler in accordance with the present disclosure.
Figure 12B:
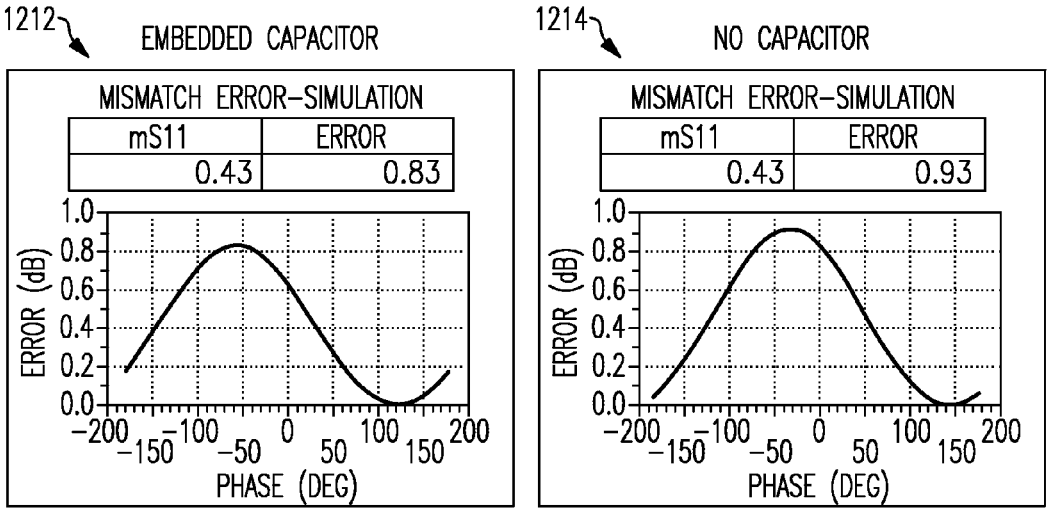

FIGS. 12A-B illustrate an example simulated design and comparison design, and simulation results for an embedded capacitor coupler in accordance with the present disclosure. FIG. 12A shows two side-coupled strip couplers designed for 1.88 GHz included with circuits 1202 and 1206. The circuit 1202 also includes an embedded capacitor 1204 connected to the output port of the coupler. The circuit 1206 does not include an embedded capacitor. Both the circuits 1202 and 1206 are simulations of 3 mm×3 mm PAMs. In a number of embodiments, the embedded capacitor 1204 is selected to improve peak-to-peak error, or coupling coefficient variation. The embedded capacitor 1204 can be of any shape. Further, in some embodiments, the capacitor 1204 can be located at any substrate layer. In certain embodiments, the capacitor 1204 can be located at any layer except the ground layer. In a number of implementations, the parasitic capacitance can be varied based on selected implementation requirements. In the simulated design illustrated in FIG. 12A, a parasitic capacitance of less than 0.1 pF was maintained.

Simulation results for the two designs demonstrate that the peak-to-peak error for the coupler with the embedded capacitor is reduced from 0.93 dB to 0.83 dB compared to the coupler without the embedded capacitor. This can be seen from graph 1212 and graph 1214 of FIG. 12B. Further, the improvement in the peak-to-peak error reading indicates an improvement in the equivalent directivity.

Experimental Results for a Floating Capacitor Coupler

Figure 13A:
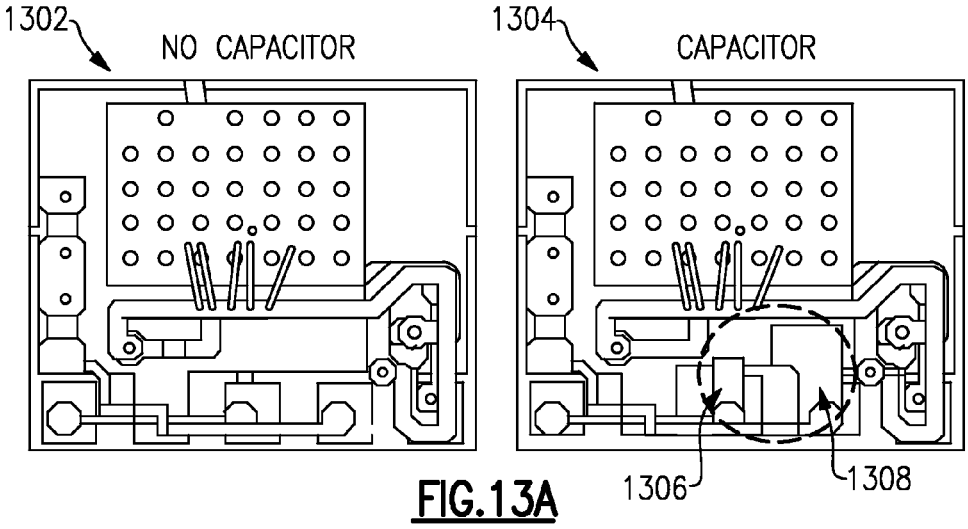
FIGS. 13A-B illustrate an example simulated design and comparison design, and simulation results for a floating capacitor coupler in accordance with the present disclosure.
Figure 13B:
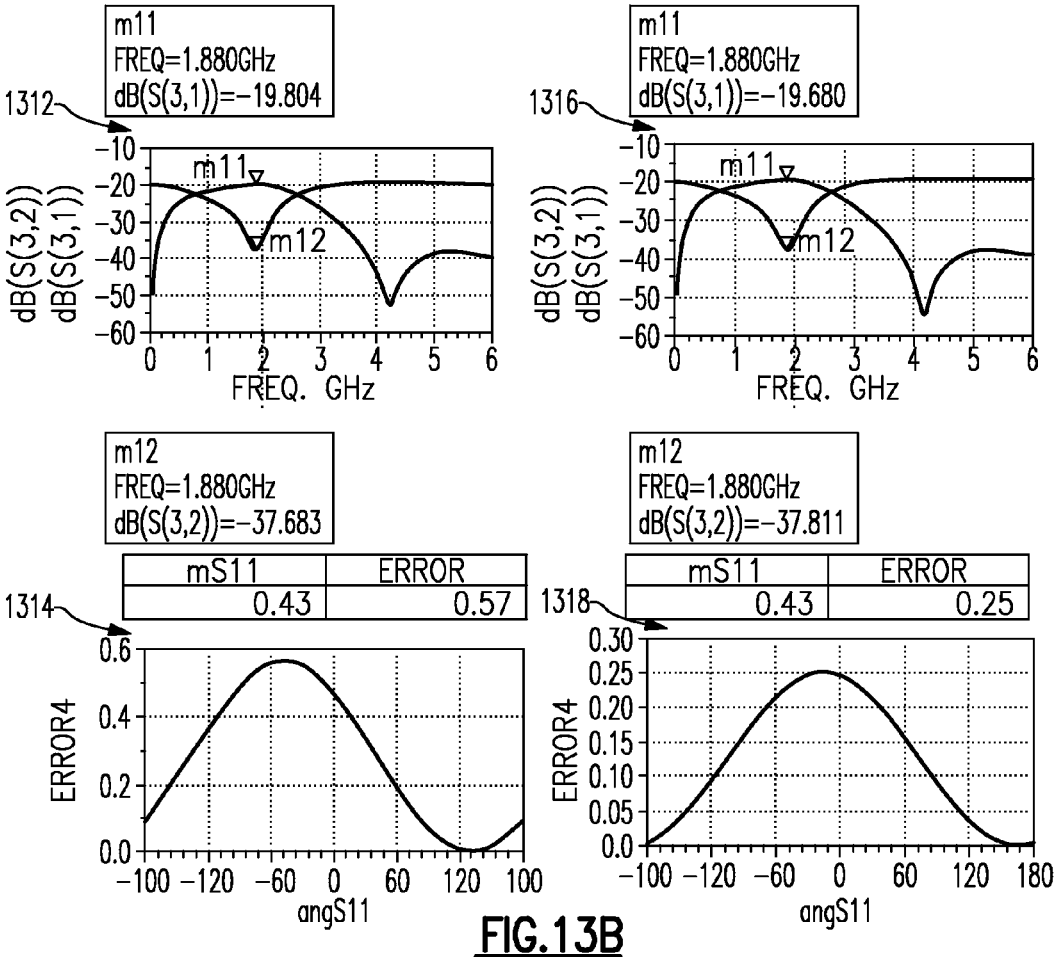

FIGS. 13A-B illustrate an example simulated design and comparison design, and simulation results for a floating capacitor coupler in accordance with the present disclosure. FIG. 13A shows two side-coupled strip couplers designed for 1.88 GHz included with circuits 1302 and 1304. The couplers were created on a 6-layer substrate. In the depicted embodiments, the first trace, or the main line, associated with the input port and the output port is located on Layer 2. The second trace, or the coupled line, associated with the coupled port and the isolated port is located on Layer 3. However, the couplers are not limited as depicted and the traces may be located on different layers and/or associated with a substrate of a different number of layers.

Both the circuits 1302 and 1304 are simulations of 3 mm×3 mm PAMs. The circuit 1304 also includes a pair of floating capacitors 1306 and 1308 connected to the coupler. The floating capacitor 1308 is connected to the output port and the floating capacitor 1306 is connected to the isolated port of the coupler. Both of the floating capacitors 1306 and 1308 are selected to improve peak-to-peak error, or coupling coefficient variation. As with the embedded capacitor 1204, the floating capacitors 1306 and 1308 can be created in any shape. In the depicted embodiment, the floating capacitors 1306 and 1308 were both located on Layer 5 of the substrate. However, they can be located at any layer. In some embodiments, the floating capacitors 1306 and 1308 can be located at any layer except for the ground layer. In a number of embodiments, the parasitic capacitance can be varied based on selected implementation requirements. In the simulated design illustrated in FIG. 13A, a parasitic capacitance of 0.2 pF and 0.6 pF was maintained for the floating capacitors 1306 and 1308 respectively. Although two capacitors are illustrated, one or more capacitors may be used with the coupler of the circuit 1304. The circuit 1302 does not include a floating capacitor.

Simulation results for the two designs demonstrate that the peak-to-peak error for the coupler with the floating capacitors is reduced from 0.57 dB to 0.25 dB compared to the coupler without the floating capacitors. This can be seen from graph 1314 and graph 1318 of FIG. 13B. Further, the equivalent directivity is improved from 17.9 dB to 18.1 dB. The coupling is slightly reduced from 19.8 dB to 19.7 dB as seen from graph 1312 and 1316.

Additional Embodiments

In accordance with some embodiments, the present disclosure relates to a coupler with high-directivity and low coupler factor variation that can be used with, for example, a 3 mm×3 mm Power Amplifier Module (PAM). The coupler includes a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the coupler includes a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

According to some embodiments, the three segments of the first trace and the three segments of the second trace may create a discontinuity that induces mismatch at an output port of the coupler thereby enabling a reduction in size of the coupler to fit in a 3 mm by 3 mm module.

In some embodiments, the first trace and the second trace may be located relative to each other in the same horizontal plane. Further, the third edge of the first trace may be aligned along the third edge of the second trace. In addition, the third edge of the first trace may be separated at least a pre-determined minimum distance from the third edge of the second trace.

In some cases, the first distance of the first trace may differ from the second distance of the first trace and the first distance of the second trace differs from the second distance of the second trace. The first distance of the first trace may be less than the second distance of the first trace and the first distance of the second trace may be less than the second distance of the second trace. Alternatively, the first distance of the first trace may be greater than the second distance of the first trace and the first distance of the second trace may be greater than the second distance of the second trace. Moreover, the first distance of the first trace can be equal to the first distance of the second trace and the second distance of the first trace can be equal to the second distance of the second trace.

For some implementations, the first trace may be located above the second trace. Further, the coupler may include a dielectric material between the first trace and the second trace.

In some embodiments, the third edge of the first trace may be divided into three segments and the third edge of the second trace may be divided into three segments. In certain cases, the dimensions of the first trace and the dimensions of the second trace may be substantially equal. In particular embodiments, the first segment and the third segment of the first trace can be of substantially equal length and the first segment and the third segment of the second trace can be of substantially equal length.

In a number of embodiments, the first distance and the second distance of the first trace and the first distance and the second distance of the second trace can be selected to reduce coupling factor variation for a pre-determined coupling factor at a predetermined set of frequencies. The coupling factor may be calculated using the equation (4) above, and the coupling factor variation may be calculated using the equation (5) above.

In a number of alternate embodiments, the lengths of the three segments of the first trace and the lengths of the three segments of the second trace may be selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a packaged chip that includes a coupler with high-directivity and low coupler factor variation that can be used with, for example, a 3 mm×3 mm PAM. The coupler includes a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the coupler includes a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

In some embodiments, the first trace and the second trace may be located relative to each other in the same horizontal plane. Further, the third edge of the first trace may be aligned along the third edge of the second trace. It is also possible for the first trace to be located above the second trace.

In certain embodiments, the first distance of the first trace may be less than the second distance of the first trace and the first distance of the second trace may be less than the second distance of the second trace. Alternatively, the first distance of the first trace may be greater than the second distance of the first trace and the first distance of the second trace may be greater than the second distance of the second trace.

In some further embodiments, the third edge of the first trace may be divided into three segments and the third edge of the second trace may be divided into three segments.

In a number of embodiments, the first distance and the second distance of the first trace and the first distance and the second distance of the second trace can be selected to reduce coupling factor variation for a pre-determined coupling factor at a pre-determined set of frequencies. The coupling factor may be calculated using the equation (4) above, and the coupling factor variation may be calculated using the equation (5) above.

In a number of alternate embodiments, the lengths of the three segments of the first trace and the lengths of the three segments of the second trace may be selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a wireless device that includes a coupler with high-directivity and low coupler factor variation that can be used with, for example, a 3 mm×3 mm PAM. The coupler includes a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the coupler includes a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

The wireless device may include a number of additional components. For example, the wireless device may include an antenna configured to transmit and receive wireless signals. Further, the wireless device may include a number of processors configured to process signals received by the antenna and to prepare signals for transmission by the antenna. In addition, the wireless device may include one or more analog to digital and digital to analog signal convertors configured to convert signals from analog to digital and vice versa. Moreover, the wireless device may include a power source for powering the wireless device and its components. In certain implementations, the coupler of the wireless device may be configured to receive power at an input port associated with a first trace and to couple a portion of the power to a second trace associated with a coupled port. The coupler can provide the portion of the power from the coupled port to one or more components associated with the wireless device, such as an LED. Further, the coupler of the wireless device can provide the remainder of the power received at the input port to an output port, which can be used to power one or more components of the wireless device, such as a processor.

In some embodiments, the first trace and the second trace may be located relative to each other in the same horizontal plane. Further, the third edge of the first trace may be aligned along the third edge of the second trace. Moreover, the first distance of the first trace may be less than the second distance of the first trace and the first distance of the second trace may be less than the second distance of the second trace. Alternatively, the first distance of the first trace may be greater than the second distance of the first trace and the first distance of the second trace may be greater than the second distance of the second trace.

For some implementations, the first trace may be located above the second trace. Additionally, the third edge of the first trace may be divided into three segments and the third edge of the second trace may be divided into three segments.

In a number of embodiments, the first distance and the second distance of the first trace and the first distance and the second distance of the second trace can be selected to reduce coupling factor variation for a pre-determined coupling factor at a pre-determined set of frequencies. The coupling factor may be calculated using the equation (4) above, and the coupling factor variation may be calculated using the equation (5) above.

In a number of alternate embodiments, the lengths of the three segments of the first trace and the lengths of the three segments of the second trace may be selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a strip coupler with high-directivity and low coupler factor variation that can be used with, for example, a 3 mm×3 mm PAM. The strip coupler includes a first strip and a second strip positioned relative to each other. Each strip has an inner coupling edge and an outer edge. The outer edge has one segment where a width of the strip differs from one or more additional widths associated with one or more additional segments of the strip. Further, the strip coupler includes a first port configured substantially as an input port and associated with the first strip. The strip coupler also includes a second port configured substantially as an output port and associated with the first strip. In addition, the strip coupler includes a third port configured substantially as a coupled port and associated with the second strip. The strip coupler further includes a fourth port configured substantially as an isolated port and associated with the second strip. Although not limited as such, the isolated port may be terminated.

In accordance with some embodiments, the present disclosure relates to a method of manufacturing a coupler with high-directivity and low coupler factor variation that can be used with, for example, a 3 mm×3 mm PAM. The method includes forming a first trace, which includes a first edge substantially parallel to a second edge and substantially equal in length to the second edge. The first trace further includes a third edge substantially parallel to a fourth edge. The fourth edge is divided into three segments. A first segment and a third segment of the three segments are a first distance from the third edge. The second segment, located between the first segment and the third segment, is a second distance from the third edge. Further, the method includes forming a second trace, which includes a first edge substantially parallel to a second edge and substantially equal in length to the second edge. The second trace further includes a third edge substantially parallel to a fourth edge. The fourth edge is divided into three segments. A first segment and a third segment of the three segments are a first distance from the third edge. The second segment, located between the first segment and the third segment, is a second distance from the third edge.

In certain embodiments, the method may include positioning the first trace relative to the second trace in the same horizontal plane as well as aligning the third edge of the first trace along the third edge of the second trace. The first distance of the first trace can differ from the second distance of the first trace and the first distance of the second trace can differ from the second distance of the second trace.

In some embodiments, the first distance of the first trace may be less than the second distance of the first trace and the first distance of the second trace may be less than the second distance of the second trace. Alternatively, the first distance of the first trace may be greater than the second distance of the first trace and the first distance of the second trace may be greater than the second distance of the second trace. In addition, the first distance of the first trace can be equal to the first distance of the second trace and the second distance of the first trace can be equal to the second distance of the second trace.

In certain embodiments, the method can include positioning the first trace above the second trace. Further, the method can include forming a layer of dielectric material between the first trace and the second trace.

According to some implementations, the third edge of the first trace can be divided into three segments and the third edge of the second trace can be divided into three segments. Further, the dimensions of the first trace and the dimensions of the second trace may be substantially equal. Moreover, the first segment and the third segment of the first trace may be of substantially equal length and the first segment and the third segment of the second trace may be of substantially equal length.

In particular embodiments, the method can include selecting the first distance and the second distance of the first trace and the first distance and the second distance of the second trace to reduce coupling factor variation for a pre-determined coupling factor at a pre-determined set of frequencies. The coupling factor may be calculated using the equation (4) above, and the coupling factor variation may be calculated using the equation (5) above.

In certain embodiments, the method can include selecting the lengths of the three segments of the first trace and the lengths of the three segments of the second trace to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a coupler with high-directivity and low coupler factor variation that can be used with, for example, a 3 mm×3 mm PAM. The coupler includes a first trace associated with a first port and a second port. The first trace includes a first main arm, a first connecting trace connecting the first main arm to the second port, and a non-zero angle between the first main arm and the first connecting trace. Further, the coupler includes a second trace associated with a third port and a fourth port. The second trace includes a second main arm.

In certain embodiments, the non-zero angle between the first main arm and the first connecting trace may create a discontinuity that induces a mismatch at an output port of the coupler thereby enabling a reduction in size of the coupler to fit in a 3 mm by 3 mm module.

In a number of implementations, the non-zero angle may be between approximately 90 degrees and 165 degrees and in some embodiments may be approximately 145 degrees.

In some implementations, the first main arm and the second main arm may be located relative to each other in the same horizontal plane. Further, the width of the first main arm and the width of the first connecting trace can be substantially equal. In some cases, the width of the first connecting trace may decrease as the first connecting trace extends from the first main arm to the second port.

In particular implementations, the second main arm connects with the fourth port through a via. For some embodiments, the second trace can include a second connecting trace connecting the second main arm to the fourth port. According to some embodiments, an angle between the second main arm and the second connecting trace can be substantially zero.

For some embodiments, the first main arm and the second main arm can be substantially rectangular. Further, in some implementations, the first main arm and the second main arm may be substantially the same size. It is also possible for the first trace and the second trace to be on different layers. In some cases, the first trace may be located above the second trace, alternatively, the first trace may be located below the second trace. In addition, the coupler may include a dielectric material between the first trace and the second trace for some embodiments. Further, in certain embodiments, the first main arm and the second main may be different sizes.

According to some embodiments, the non-zero angle is selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a packaged chip that includes a coupler with high-directivity and low coupler factor variation that can be used with, for example, a 3 mm×3 mm PAM. The coupler includes a first trace associated with a first port and a second port. The first trace includes a first main arm, a first connecting trace connecting the first main arm to the second port, and a non-zero angle between the first main arm and the first connecting trace. Further, the coupler includes a second trace associated with a third port and a fourth port. The second trace includes a second main arm.

In a number of implementations, the non-zero angle may be between approximately 90 degrees and 165 degrees and in some embodiments may be approximately 145 degrees.

For some implementations, the first main arm and the second main arm may be located relative to each other in the same horizontal plane. Moreover, in particular implementations, the second main arm connects with the fourth port through a via. Alternatively, the second trace can include a second connecting trace connecting the second main arm to the fourth port. In a number of embodiments, an angle between the second main arm and the second connecting trace can be substantially zero.

For certain embodiments, the first trace and the second trace may be on different layers. The first trace may be located above the second trace, alternatively, the first trace may be located below the second trace. Further, in some embodiments, the coupler may include a dielectric material between the first trace and the second trace.

In certain embodiments, the non-zero angle is selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a wireless device that includes a coupler with high-directivity and low coupler factor variation that can be used with, for example, a 3 mm×3 mm PAM. The coupler includes a first trace associated with a first port and a second port. The first trace includes a first main arm, a first connecting trace connecting the first main arm to the second port, and a non-zero angle between the first main arm and the first connecting trace. Further, the coupler includes a second trace associated with a third port and a fourth port. The second trace includes a second main arm.

In a number of implementations, the non-zero angle may be between approximately 90 degrees and 165 degrees, such as approximately 145 degrees. In some implementations, the first main arm and the second main arm may be located relative to each other in the same horizontal plane.

In particular implementations, the second main arm connects with the fourth port through a via. However, in certain embodiments, the second trace can include a second connecting trace connecting the second main arm to the fourth port. Further, an angle between the second main arm and the second connecting trace can be substantially zero.

For certain embodiments, the first trace and the second trace may be on different layers. For instance, in a number of embodiments, the first trace may be located above the second trace, alternatively, the first trace may be located below the second trace. According to some embodiments, the coupler may include a dielectric material between the first trace and the second trace.

In certain embodiments, the non-zero angle is selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a strip coupler with high-directivity and low coupler factor variation that can be used with, for example, a 3 mm×3 mm PAM. The strip coupler including a first strip and a second strip positioned relative to each other. Each strip has an inner coupling edge and an outer edge. The first strip includes a connecting trace connecting a main arm of the first strip to a second port. The connecting trace and the main arm are joined at a non-zero angle. The second strip includes a main arm communicating with a fourth port without the main arm joined to a connecting trace at a non-zero angle. The strip coupler further includes a first port configured substantially as an input port and associated with the first strip. The second port is configured substantially as an output port and associated with the first strip. In addition, the strip coupler includes a third port configured substantially as a coupled port and associated with the second strip. The fourth port is configured substantially as an isolated port and associated with the second strip. In a number of implementations, the isolated port may be terminated.

In accordance with some embodiments, the present disclosure relates to a method of manufacturing a coupler with high-directivity and low coupler factor variation that can be used with, for example, a 3 mm×3 mm PAM. The method includes forming a first trace associated with a first port and a second port. The first trace includes a first main arm, a first connecting trace connecting the first main arm to the second port, and a non-zero angle between the first main arm and the first connecting trace. The method further includes forming a second trace associated with a third port and a fourth port. The second trace includes a second main arm.

In a number of implementations, the non-zero angle may be between approximately 90 degrees and 165 degrees, such as, in some embodiments, approximately 145 degrees. Further, in some implementations, the first main arm and the second main arm may be located relative to each other in the same horizontal plane. Additionally, in particular embodiments, the width of the first main arm and the width of the first connecting trace can be substantially equal. However, in some cases, the method can include decreasing the width of the first connecting trace as the first connecting trace extends from the first main arm to the second port.

For particular embodiments, the method can include connecting the second main arm with the fourth port through a via. Although, in certain embodiments, the second trace can include a second connecting trace connecting the second main arm to the fourth port. While not limited as such, in a number of embodiments, an angle between the second main arm and the second connecting trace can be substantially zero.

For some embodiments, the first main arm and the second main arm can be substantially rectangular. Further, the first main arm and the second main arm may be substantially the same size. In some cases, the first trace and the second trace may be on different layers. For some embodiments, the first trace may be located above the second trace, alternatively, the first trace may be located below the second trace. Moreover, in some embodiments, the method may include forming a layer of dielectric material between the first trace and the second trace. For certain embodiments, the first main arm and the second main arm may be different sizes.

In certain embodiments, the method may include selecting the non-zero angle to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a coupler with high-directivity and low coupler factor variation that can be used with, for example, a 3 mm×3 mm PAM. The coupler includes a first trace associated with a first port and a second port. The first port is configured substantially as an input port and the second port is configured substantially as an output port. The coupler further includes a second trace associated with a third port and a fourth port. The third port is configured substantially as a coupled port and the fourth port is configured substantially as an isolated port. In addition, the coupler includes a first capacitor configured to introduce a discontinuity to induce a mismatch in the coupler.

In some embodiments, the discontinuity created by the first capacitor may enable a reduction in size of the coupler to fit in a 3 mm by 3 mm module.

In a number of implementations, the first capacitor may be an embedded capacitor, alternatively, the first capacitor can be a floating capacitor. For a number of embodiments, the first capacitor may be in communication with the second port. Further, for some embodiments, the coupler may include a second capacitor. This second capacitor may be in communication with the fourth port. In addition, or alternatively, the first capacitor may be in communication with the fourth port.

In some embodiments, the first trace and the second trace may be located relative to each other in the same horizontal plane. For certain implementations, the first trace and the second trace can be on different layers. Moreover, the first trace may be located above the second trace or the first trace may be located below the second trace. Further, in a number of implementations, the coupler can include a dielectric material between the first trace and the second trace.

For particular embodiments, the isolated port may be terminated.

In certain embodiments, a capacitance value of the capacitor may be selected to reduce coupling factor variation for a pre-determined coupling factor at a pre-determined set of frequencies. The coupling factor may be calculated using the equation (4) above, and the coupling factor variation may be calculated using the equation (5) above. In some implementations, one or more of a geometry of the capacitor and a placement of the capacitor is selected to reduce the coupling factor variation.

In accordance with some embodiments, the present disclosure relates to a packaged chip that includes a coupler with high-directivity and low coupler factor variation that can be used with, for example, a 3 mm×3 mm PAM. The coupler includes a first trace associated with a first port and a second port. The first port is configured substantially as an input port and the second port is configured substantially as an output port. The coupler further includes a second trace associated with a third port and a fourth port. The third port is configured substantially as a coupled port and the fourth port is configured substantially as an isolated port. In addition, the coupler includes a first capacitor configured to introduce a discontinuity to induce a mismatch in the coupler.

In a number of implementations, the first capacitor may be an embedded capacitor or it may be a floating capacitor. Further, for a number of embodiments, the first capacitor may be in communication with the second port. Additionally, in some embodiments, the coupler may include a second capacitor. This second capacitor may be in communication with the fourth port. Further, in some implementations, the first capacitor may be in communication with the fourth port.

In some embodiments, the first trace and the second trace may be located relative to each other in the same horizontal plane, alternatively, the first trace and the second trace can be on different layers. In a number of embodiments, the first trace may be located above the second trace or the first trace may be located below the second trace. Particular embodiments can include a dielectric material between the first trace and the second trace. Additionally, for some embodiments, the isolated port may include a termination.

In certain embodiments, a capacitance value of the capacitor may be selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a wireless device that includes a coupler with high-directivity and low coupler factor variation that can be used with, for example, a 3 mm×3 mm PAM. The coupler includes a first trace associated with a first port and a second port. The first port is configured substantially as an input port and the second port is configured substantially as an output port. The coupler further includes a second trace associated with a third port and a fourth port. The third port is configured substantially as a coupled port and the fourth port is configured substantially as an isolated port. In addition, the coupler includes a first capacitor configured to introduce a discontinuity to induce a mismatch in the coupler.

In a number of implementations, the first capacitor may be an embedded capacitor, a floating capacitor, or a parasitic capacitor. Further, for a number of embodiments, the first capacitor may be in communication with the second port. And in some embodiments, the coupler may include a second capacitor. This second capacitor may be in communication with the fourth port. In some implementations, the first capacitor may be in communication with the fourth port.

In some embodiments, the first trace and the second trace may be located relative to each other in the same horizontal plane. But, for certain implementations, the first trace and the second trace can be on different layers. In a number of embodiments, the first trace may be located above the second trace. For other embodiments, the first trace may be located below the second trace. In a number of implementations, the coupler can include a dielectric material between the first trace and the second trace. Further embodiments include a termination associated with the isolated port.

In certain embodiments, a capacitance value of the capacitor may be selected to reduce coupling factor variation for a pre-determined coupling factor at a pre-determined set of frequencies. The coupling factor may be calculated using the equation (4) above, and the coupling factor variation may be calculated using the equation (5) above.

In accordance with some embodiments, the present disclosure relates to a method of manufacturing a coupler with high-directivity and low coupler factor variation that can be used with, for example, a 3 mm×3 mm PAM. The method includes forming a first trace associated with a first port and a second port. The first port is configured substantially as an input port and the second port is configured substantially as an output port. The method further includes forming a second trace associated with a third port and a fourth port. The third port is configured substantially as a coupled port and the fourth port is configured substantially as an isolated port. In addition, the method includes connecting a first capacitor to the second port. The first capacitor is configured to introduce a discontinuity to induce a mismatch in the coupler.

In a number of implementations, the first capacitor may be one of an embedded capacitor and a floating capacitor. For a number of embodiments, the method may include connecting a second capacitor to the fourth port and in some implementations, the first capacitor may be in communication with the fourth port.

In some embodiments, the first trace and the second trace may be located relative to each other in the same horizontal plane. But, for certain implementations, the first trace and the second trace can be on different layers. In a number of embodiments, the first trace may be located above the second trace while in other embodiments, the first trace may be located below the second trace. In a number of implementations, the method may include forming a layer of dielectric material between the first trace and the second trace. Further, in particular embodiments, the method may include terminating the isolated port.

In certain embodiments, the method may include selecting a capacitance value of the capacitor to reduce coupling factor variation for a pre-determined coupling factor at a pre-determined set of frequencies. The coupling factor may be calculated using the equation (4) above, and the coupling factor variation may be calculated using the equation (5) above.

Terminology

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, can include a term relating to the distribution of power from one conductor, such as a conducting trace to another conductor, such as a second conducting trace. Where the term "coupled" is used to refer to the connection between two elements, the term refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While certain embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A coupler comprising:

a first conductive trace, the first conductive trace including a first segment of a first width, a second segment of a second width, and a third segment of the first width, the second segment located between the first segment and the third segment, the second width differing from the first width; and a second conductive trace positioned below the first conductive trace, the second conductive trace including a first segment of the first width, a second segment of the second width, and a third segment of the first width, the second segment located between the first segment and the third segment, the first width and the second width selected to reduce a coupling factor variation for a coupling factor at a particular operating frequency for the coupler, the second conductive trace offset with respect to a center of the first conductive trace.

2. A wireless device comprising:

signal processing circuitry configured to process a signal; and a coupler in electrical communication with the signal processing circuitry, the coupler including a first conductive trace and a second conductive trace, the first conductive trace including a first segment of a first width, a second segment of a second width, and a third segment of the first width, the second segment located between the first segment and the third segment, the second width differing from the first width, the second conductive trace positioned below the first conductive trace, the second conductive trace including a first segment of the first width, a second segment of the second width, and a third segment of the first width, the second segment located between the first segment and the third segment, the first width and the second width selected to reduce a coupling factor variation for a coupling factor at a particular operating frequency for the coupler, the second conductive trace partially offset from the first conductive trace.

3. A coupler comprising:

a first conductive trace, the first conductive trace including a first segment of a first width, a second segment of a second width, and a third segment of the first width, the second segment located between the first segment and the third segment, the second width differing from the first width, and a length of the first segment of the first conductive trace, a length of the second segment of the first conductive trace, and a length of the third segment of the first conductive trace differing; and a second conductive trace positioned below the first conductive trace, the second conductive trace including a first segment of the first width, a second segment of the second width, and a third segment of the first width, the second segment located between the first segment and the third segment, the first width and the second width selected to reduce a coupling factor variation for a coupling factor at a particular operating frequency for the coupler.

4. The coupler of claim 3 wherein the second conductive trace is aligned with the first conductive trace.

5. The coupler of claim 3 wherein the first conductive trace and the second conductive trace are configured to introduce a discontinuity that induces a mismatch at an output port of the coupler and increases a directivity of the coupler.

6. The coupler of claim 3 wherein the second conductive trace is positioned a particular distance below the first conductive trace to enable a particular portion of power applied to the first conductive trace to be coupled to the second conductive trace.

7. The coupler of claim 3 further comprising a dielectric material positioned between the first conductive trace and the second conductive trace, the dielectric material below the first conductive trace and above the second conductive trace.

8. The coupler of claim 7 wherein the first conductive trace is formed on a first side of the dielectric material and the second conductive trace is formed on a second side of the dielectric material.

9. A wireless device comprising:

signal processing circuitry configured to process a signal; and a coupler in electrical communication with the signal processing circuitry, the coupler including a first conductive trace and a second conductive trace, the first conductive trace including a first segment of a first width, a second segment of a second width, and a third segment of the first width, the second segment located between the first segment and the third segment, the second width differing from the first width, the second conductive trace positioned below the first conductive trace, the second conductive trace including a first segment of the first width, a second segment of the second width, and a third segment of the first width, the second segment located between the first segment and the third segment, the first width and the second width selected to reduce a coupling factor variation for a coupling factor at a particular operating frequency for the coupler, at least one of the first segment of the first conductive trace, the second segment of the first conductive trace, and the third segment of the first conductive trace is of a different length than at least one other segment of the first conductive trace.

10. The wireless device of claim 9 wherein the first conductive trace and the second conductive trace introduce a discontinuity that induces a mismatch at a port of the coupler and increases a directivity of the coupler.

11. The wireless device of claim 9 wherein the signal processing circuitry includes a power amplifier.

12. The wireless device of claim 9 wherein the coupler further includes a dielectric material positioned between the first conductive trace and the second conductive trace, the dielectric material below the first conductive trace and above the second conductive trace.

13. The wireless device of claim 12 wherein the first conductive trace is formed on a first side of the dielectric material and the second conductive trace is formed on a second side of the dielectric material.

14. A method of manufacturing a coupler, the method comprising:

forming a first conductive trace, the first conductive trace including a first segment of a first width, a second segment of a second width, and a third segment of the first width, the second segment located between the first segment and the third segment, the second width differing from the first width; and forming a second conductive trace below the first conductive trace, the second conductive trace including a first segment of the first width, a second segment of the second width, and a third segment of the first width, the second segment located between the first segment and the third segment, the first width and the second width selected to reduce a coupling factor variation for a coupling factor at a particular operating frequency for the coupler, the forming the second conductive trace below the first conductive trace further including partially offsetting the second conductive trace from the first conductive trace.

15. The method of claim 14 wherein forming the first conductive trace further includes forming the first conductive trace on a first side of a dielectric material.

16. The method of claim 15 wherein forming the second conductive trace further includes forming the second conductive trace on a second side of the dielectric material.

17. The method of claim 14 wherein the first conductive trace and the second conductive trace introduce a discontinuity that induces a mismatch at a port of the coupler and increases a directivity of the coupler.

* * * * *